US009440474B2

(12) United States Patent
Araki et al.

(10) Patent No.: US 9,440,474 B2
(45) Date of Patent: Sep. 13, 2016

(54) RECORDING MEDIUM

(71) Applicant: CANON KABUSHIKI KAISHA, Tokyo (JP)

(72) Inventors: Kazuhiko Araki, Kawasaki (JP); Hisao Kamo, Ushiku (JP); Yasuhiro Nito, Inagi (JP); Tetsuro Noguchi, Hachioji (JP); Ryo Taguri, Sagamihara (JP); Isamu Oguri, Yokohama (JP); Olivia Herlambang, Kawasaki (JP); Naoya Hatta, Kawasaki (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/675,399

(22) Filed: Mar. 31, 2015

(65) Prior Publication Data

US 2015/0283841 A1 Oct. 8, 2015

(30) Foreign Application Priority Data

Apr. 2, 2014 (JP) ..... 2014-076149

(51) Int. Cl.
*B41M 5/00* (2006.01)
*B41M 5/52* (2006.01)
*B41M 5/50* (2006.01)

(52) U.S. Cl.
CPC ..... *B41M 5/5254* (2013.01); *B41M 5/502* (2013.01); *B41M 5/506* (2013.01); *B41M 5/52* (2013.01); *B41M 5/5218* (2013.01); *B41M 2205/38* (2013.01)

(58) Field of Classification Search
CPC B41M 5/5254; B41M 5/5218; B41M 5/502; B41M 5/506
See application file for complete search history.

(56) References Cited

U.S. PATENT DOCUMENTS

| | | | | |
|---|---|---|---|---|
| 6,387,473 | B1 | 5/2002 | Sismondi et al. | |
| 8,524,336 | B2 * | 9/2013 | Oguri et al. | 428/32.25 |
| 8,592,012 | B2 * | 11/2013 | Noguchi et al. | 428/32.24 |
| 8,679,597 | B2 * | 3/2014 | Nito et al. | 428/32.18 |
| 2001/0004487 | A1 | 6/2001 | Kaneko et al. | |
| 2003/0049420 | A1 | 3/2003 | Inoue et al. | |
| 2003/0072925 | A1 | 4/2003 | Kiyama et al. | |
| 2003/0081103 | A1 | 5/2003 | Ishimaru et al. | |
| 2006/0182903 | A1 * | 8/2006 | Sakaguchi et al. | 428/32.24 |
| 2008/0241436 | A1 | 10/2008 | Kobayashi | |
| 2009/0109270 | A1 * | 4/2009 | Kobayashi | 347/106 |
| 2011/0256324 | A1 | 10/2011 | Noguchi | |
| 2012/0207949 | A1 | 8/2012 | Noguchi et al. | |

FOREIGN PATENT DOCUMENTS

| | | | |
|---|---|---|---|
| EP | 1580017 | A1 | 9/2005 |
| EP | 2487045 | A2 | 8/2012 |
| EP | 2586620 | A2 | 5/2013 |
| EP | 2594407 | A1 | 5/2013 |
| JP | 2004001528 | A | 1/2004 |

* cited by examiner

*Primary Examiner* — Betelhem Shewareged
(74) *Attorney, Agent, or Firm* — Canon U.S.A., Inc., IP Division

(57) ABSTRACT

A recording medium includes a substrate, a first ink receiving layer and a second ink receiving layer in that order. The first ink receiving layer contains at least one inorganic pigment selected from the group consisting of alumina, hydrated alumina and fumed silica, polyvinyl alcohol, and a boric acid compound. The second ink receiving layer contains fumed silica, particles having an average particle size in a specific range, polyvinyl alcohol, and a boric acid compound. The boric acid compound content in the first ink receiving layer is in a predetermined range, and the boric acid compound content in the second ink receiving layer is in a predetermined range. The particle content in the second ink receiving layer is in a predetermined range.

16 Claims, No Drawings

RECORDING MEDIUM

BACKGROUND OF THE INVENTION

1. Field of the Invention

The present application relates to a recording medium.

2. Description of the Related Art

A recording medium including an ink receiving layer on a substrate has been known as a recording medium used for recording with ink. The recording medium of this type is being required to have higher ink absorbency as the recording speed is increased.

Japanese Patent Laid-Open No. 2004-1528 discloses a recording medium including two ink receiving layers on a substrate. This recording medium is produced in such a manner that the ratio of the binder content to the pigment content in the ink receiving layer more distant from the substrate can be lower than that in the other ink receiving layer (closer to the substrate). The recording medium thus achieves a high ink absorbency, and in which the adhesion between the substrate and the ink receiving layers is increased to prevent the ink receiving layers from cracking.

Nowadays, there are many cases of binding an on-demand photographic collection containing photographs or combinations of letters and photographs, that is, a photo books or a photo albums in which images are arranged on both sides of each page. In such a binding process, the following method is used in some cases. In the method, images are formed only on one side of a recording medium, and a fold line is formed in the recording medium. A plurality of recording media thus prepared are folded in half along the fold line. Each set of two folded recording media is bonded together with the rear sides facing each other, and the sets of folded recording media are bound together. This binding method allows two pages opposite each other to spread around the fold line, and also allows a large photograph or image to be arranged across two pages, thus providing more high-quality photo books and photo albums than ordinary binding processes. When such a two-page spreadable photo book or photo album is bound, the ink receiving layer of the recording medium is likely to be cracked at the fold line or to peel off partially, thereby degrading the appearance of the image. Accordingly, a recording medium having high resistance to fold cracking (hereinafter referred to as fold crack resistance) is desirable. In addition, it is important that users can turn pages of the photo book smoothly by hand without a sense of discomfort. That is, it is important for the recording to be easy to turn by hand (this characteristic hereinafter referred to as ease of page turning). According to some studies of the present inventors, however, the recording medium disclosed in the above-cited patent document does not have sufficient fold crack resistance or ease of page turning.

SUMMARY OF THE INVENTION

Aspects of the present application provide a recording medium that has high color developability, glossiness and high ink absorbency, and that, in addition, is capable of preventing cracking and easy to tuning pages.

Accordingly, aspects of the present application are embodied as below.

In an embodiment of the present application, a recording medium is provided which includes a substrate, a first ink receiving layer, and a second ink receiving layer acting as the outermost layer, in that order. The first ink receiving layer contains a first inorganic pigment, polyvinyl alcohol, and a boric acid compound. The first inorganic pigment contains at least one selected from the group consisting of alumina, hydrated alumina and fumed silica. The second ink receiving layer contains fumed silica as a second inorganic pigment, particles having an average particle size in the range of 1.0 μm to 20.0 μm, polyvinyl alcohol, and a boric acid compound. In the first ink receiving layer, the boric acid compound content is in the range of 2.0 parts by mass to 7.0 parts by mass relative to 100 parts by mass of the polyvinyl alcohol. In the second ink receiving layer, the boric acid compound content is in the range of 10.0 parts by mass to 30.0 parts by mass relative to 100 parts by mass of the polyvinyl alcohol. In the second ink receiving layer, the content of the particles having an average particle size in the range of 1.0 μm to 20.0 μm is in the range of 0.5 part by mass to 5.0 parts by mass relative to 100 parts by mass of the second inorganic pigment.

In another embodiment, a recording medium includes a substrate, a first ink receiving layer, a second ink receiving layer, and a third ink receiving layer acting as the outermost layer, in that order. The first ink receiving layer contains a first inorganic pigment, polyvinyl alcohol, and a boric acid compound. The first inorganic pigment contains at least one selected from the group consisting of alumina, hydrated alumina and fumed silica. The second ink receiving layer contains fumed silica as a second inorganic pigment, polyvinyl alcohol, and a boric acid compound. The third ink receiving layer contains fumed silica as a third inorganic pigment, particles having an average particle size in the range of 1.0 μm to 20.0 μm, polyvinyl alcohol, and a boric acid compound. In the first ink receiving layer, the boric acid compound content is in the range of 2.0 parts by mass to 7.0 parts by mass relative to 100 parts by mass of the polyvinyl alcohol. In the second ink receiving layer, the boric acid compound content is in the range of 10.0 parts by mass to 30.0 parts by mass relative to 100 parts by mass of the polyvinyl alcohol. In the third ink receiving layer, the boric acid compound content is in the range of 10.0 parts by mass to 30.0 parts by mass relative to 100 parts by mass of the polyvinyl alcohol. In the third ink receiving layer, the content of the particles having an average particle size in the range of 1.0 μm to 20.0 μm is in the range of 0.5 part by mass to 5.0 parts by mass relative to 100 parts by mass of the third inorganic pigment.

Further features of the present application will become apparent from the following description of exemplary embodiments.

DESCRIPTION OF THE EMBODIMENTS

Circumstances that led to the present application will first be described.

In many of the single-layer ink receiving layers containing an inorganic pigment, polyvinyl alcohol, and a crosslinking agent such as boric acid, the crosslinking agent content is relatively high, and accordingly the degree of crosslinking of the ink receiving layer tends to be high. An ink receiving layer having a high degree of crosslinking tends to be prevented effectively from being cracked when the coating liquid of the ink receiving layer is applied or dried (after being applied), and can have a high ink absorbency. Such an ink receiving layer however can be hard and brittle, and inferior particularly in fold crack resistance.

On the other hand, an ink receiving layer not containing a crosslinking agent is likely to crack after the coating liquid is applied and exhibit low ink absorbency. In addition, although it is generally considered that ink receiving layers not containing a crosslinking agent tend to have high fold crack resistance, some of such ink receiving layers exhibit low fold crack resistance on the contrary. The reason of this is not clear, but can be that if the polyvinyl alcohol is not crosslinked at all, the binding force between the polyvinyl alcohol and the inorganic pigment or the binding force between the polyvinyl alcohol and the substrate (particularly water-resistant substrate) decreases.

The present inventors have found through their intensive research that an ink receiving layer in which polyvinyl alcohol is crosslinked to a specific extent exhibits a high fold crack resistance. The present inventors have also found that there is an optimum range of the degree of crosslinking of polyvinyl alcohol in view of fold crack resistance, and that some of the ink receiving layers however crack (particularly when dried after the coating liquid has been applied) or have poor ink absorbency even though the degree of crosslinking is in this optimum range. Accordingly, the present inventors have thought of an ink receiving layer including a first ink receiving layer and a second ink receiving layer, each in which the polyvinyl alcohol has a specific degree of crosslinking, and have found this structure can reduce the occurrence of cracks and increase the ink absorbency and fold crack resistance of the ink receiving layer.

Also, the present inventors have found that by adding particles having a specific particle size to the outermost layer of the recording medium, the occurrence of cracks can be further reduced, and the glossiness and ease of page turning of the recording medium can be improved without degrading the ink absorbency and fold crack resistance.

Recording Medium

The recording medium of an embodiment of the application will now be described in detail.

The recording medium includes a substrate, a first ink receiving layer, and a second ink receiving layer in that order.

In an embodiment, the second ink receiving layer is the outermost layer (layer most distant from the substrate). In another embodiment, a third ink receiving layer is disposed on the second ink receiving layer and acts as the outermost layer.

In each embodiment, the outermost layer contains particles having an average particle size in the range of 1.0 μm to 20.0 μm.

In an embodiment where the second ink receiving layer acts as the outermost layer, the second ink receiving layer contains particles having an average particle size in the range of 1.0 μm to 20.0 μm. In an embodiment where the third ink receiving layer disposed on the second ink receiving layer to act as the outermost layer, the third ink receiving layer contains particles having an average particle size in the range of 1.0 μm to 20.0 μm.

In an embodiment, the outermost layer may be provided with another layer thereon as long as the advantage of the invention is reduced. Also, the substrate and the first ink receiving layer, the first ink receiving layer and the second ink receiving layer, or the second ink receiving layer and the third ink receiving layer may be separated by a further ink receiving layer. It is however advantageous that the first ink receiving layer is adjacent to the second ink receiving layer. It is also advantageous that the second ink receiving layer is adjacent to the third ink receiving layer.

Substrate

The substrate may be resistant to water. The water-resistant substrate may be a resin-coated paper produced by coating a base paper with a resin, synthetic paper or a plastic film. A resin-coated paper is advantageous as the water-resistant substrate.

The base pater of the resin-coated paper may be a generally used plain paper or, advantageously, a smooth base paper as used as the substrate of photographs. A particularly advantageous substrate may be a paper sheet whose surface has been compressed so as to have high smoothness by calendering or any other method for applying pressure during or after paper making. The base paper may be made of, for example, natural pulp, recycled pulp, synthesized pulp, or the like. These pulps may be used singly or in combination. The base paper may contain additives generally used for paper making, such as a sizing agent, a paper strengthening agent, a filler, an antistatic agent, a fluorescent brightening agent, and a dye. Furthermore, the surface of the base paper may be coated with a surface sizing agent, a surface paper strengthening agent, a fluorescent brightening agent, an antistatic agent, a dye, an anchoring agent, or the like. The base paper desirably has a density in the range of 0.6 g/cm$^3$ to 1.2 g/cm$^3$, such as 0.7 g/cm$^3$ or more. The base paper having a density of 1.2 g/cm$^3$ or less helps prevent the cushioning property and ease of conveyance of the recording medium from decreasing. Also, the base paper having a density of 0.6 g/cm$^3$ or more helps prevent the smoothness of the surface of the recording medium from decreasing. The thickness of the base paper is desirably 50.0 μm or more. The base paper having a thickness of 50.0 μm or more helps increase the strength against pulling and tearing and improve the texture of the recording medium. The thickness of the base paper is desirably 350.0 μm or less from the viewpoint of productivity. The resin layer coating the base paper desirably has a thickness of 5.0 μm or more, preferably 8.0 μm or more. In addition, thickness of the resin layer is desirably 40.0 μm or less, preferably 35.0 μm or less. When the resin layer coating the base paper has a thickness of 5.0 μm or more, the resin layer can prevent water or gas from permeating the base paper and suppress cracks effectively in the ink receiving layer caused by bending. Also, when the thickness of the resin layer coating the base paper is 40.0 μm or less, the recording medium can be prevented effectively from curling. The resin of the resin layer may be a low density polyethylene (LDPE) or a high density polyethylene (HDPE). Alternatively, linear low-density polyethylene (LLDPE) or polypropylene may be used. Particularly for the resin layer on the side on which the ink receiving layer is formed, it is advantageous from the viewpoint of improving opacity, whiteness and hue to add titanium oxide in the form of rutile or anatase, a fluorescent brightening agent and ultramarine to polyethylene. If the resin layer contains titanium oxide, the titanium oxide content is desirably 3.0% by mass or more, preferably 4.0% by mass or more, relative to the total mass of the resin layer. Also, the titanium oxide content is desirably 20.0% by mass or less, preferably 13.0% by mass or less, relative to the total mass of the resin layer.

The plastic film used as the substrate may be a film made of a thermoplastic resin, such as polyethylene, polypropylene, polystyrene, polyvinyl chloride, or polyester, or a thermosetting resin, such as a urea resin, a melamine resin, or a phenol resin. The plastic film desirably has a thickness in the range of 50.0 μm to 250.0 μm.

The surface of the substrate may be glossy, semi-glossy or matte, or may have any other texture as desired. It is however advantageous that the substrate has a semi-glossy or matte surface. The semi-glossy or matte surface may be formed by, for example, embossing using a roller having a relief pattern at the surface thereof when the surface of a base paper is coated with a resin by melt extrusion. By forming an ink receiving layer on a substrate having such a semi-glossy or matte surface, a pattern reflecting the relief pattern of the substrate is formed in the surface of the substrate. Thus, glare resulting from excessive gloss can be reduced. In addition, the adhesion area of the substrate with the ink receiving layer increases to enhance the fold crack resistance. The arithmetic average surface roughness Ra, at a cut-off length of 0.8 mm specified in JIS B 0601: 2001, of the surface of the recording medium is desirably in the range of 0.3 μm to 6.0 μm, preferably in the range of 0.5 μm to 3.0 μm. The surface of the recording medium having an arithmetic average surface roughness Ra in the range of 0.3 μm to 6.0 μm tends to have high glossiness.

In an embodiment of the present application, the surface of the substrate on which the ink receiving layer will be formed may be provided with a primer layer mainly containing a hydrophilic polymer such as gelatin or polyvinyl alcohol. Alternatively, the surface of the substrate on which the ink receiving layer will be formed may be subjected to treatment for facilitating adhesion by, for example, corona discharge or plasma. These surface treatments increase the adhesion between the substrate and the ink receiving layer.

The ink receiving layer will now be described in detail.

Ink Receiving Layer

The first, the second and the third ink receiving layer may be formed by applying their respective coating liquids to the substrate, followed by being dried.

The total thickness of the ink receiving layer is desirably 15.0 μm or more, preferably 20.0 μm or more. Also, the total thickness of the ink receiving layer is desirably 50.0 μm or less, preferably 40.0 μm or less. The ink receiving layer having a total thickness in the range of 15.0 μm to 50.0 μm facilitates the increase of fold crack resistance, ink absorbency and color developability. Preferably, the total thickness of the ink receiving layer is in the range of 30.0 μm to 38.0 μm.

The first ink receiving layer contains a first inorganic pigment that is at least one inorganic material selected from the group consisting of alumina, hydrated alumina and fumed silica, polyvinyl alcohol, and a boric acid compound.

The second ink receiving layer contains fumed silica as a second inorganic pigment, polyvinyl alcohol, and a boric acid compound. In an embodiment where the second ink receiving layer acts as the outermost layer, the second ink receiving layer further contains particles having an average particle size in the range of 1.0 μm to 20.0 μm.

In an embodiment where the third ink receiving layer acts as the outermost layer, the third ink receiving layer contains fumed silica as a third inorganic pigment, polyvinyl alcohol, a boric acid compound and particles having an average particle size in the range of 1.0 μm to 20.0 μm.

The constituents of the ink receiving layer will now be described.

Alumina

Examples of alumina include γ-alumina, α-alumina, δ-alumina, θ-alumina, and χ-alumina. From the viewpoint of color developability (image density) and ink absorbency, γ-alumina is advantageously used. A commercially available γ-alumina produced by gas phase process (for example, AEROXIDE Alu C produced by EVONIK) may be used.

The number average particle size of the primary particles of the alumina is desirably in the range of 5 nm to 50 nm, preferably 5 nm to 30 nm.

In the coating liquid (dispersion liquid) for the first ink receiving layer, the alumina desirably has an average particle size (secondary particle size) in the range of 50 nm to 300 nm, preferably 100 nm to 200 nm.

Hydrated Alumina

The hydrated alumina used in the ink receiving layer may be expressed by the following general formula (X): $Al_2O_{3-n}(OH)_2.mH_2O$. (n represents 0, 1, 2 or 3; m represents a numeral in the range of 0 to 10, preferably in the range of 0 to 5; and m and n are not simultaneously set to 0; $mH_2O$ represents a desorbable water that is often not involved in the formation of crystal lattices, and m may be or may not be integer. Heating can reduce the value of m to 0.)

The hydrated alumina may be amorphous or have a crystal structure in the form of gibbsite or boehmite, depending on the temperature of heat treatment. Any of these types of hydrated alumina may be used. Hydrated alumina exhibiting the form of boehmite or amorphous in X-ray diffraction analysis is advantageous. For example, hydrated alumina disclosed in Japanese Patent Laid-Open Nos. 7-232473, 8-132731, and 9-66664 and 9-76628 are advantageously used. The particles of the hydrated alumina may have irregular shapes or a regular shape such as spherical or plate-like shape. Either or both hydrated alumina particles having irregular shapes or hydrated alumina particles having a regular shape may be used. Hydrated alumina having a number average primary particle size in the range of 5 nm to 50 nm is advantageous, and plate-like hydrated alumina particles having an aspect ratio of 2 or more are advantageous. The aspect ratio can be measured by the method disclosed in Japanese Patent Publication No. 5-16015. The aspect ratio is represented by the ratio of the diameter of particles to the thickness thereof. The diameter mentioned here refers to the diameter (equivalent circular diameter) of a circle having an area equivalent to the projected area of hydrated alumina particles observed through an electron microscope.

In addition, the hydrated alumina desirably has a specific surface area in the range of 100 $m^2/g$ to 200 $m^2/g$ when measured by the BET method. Preferably, the specific surface area measured by the BET method (hereinafter referred to as BET specific surface area) of the hydrated alumina is 125 $m^2/g$ or more and 190 $m^2/g$ or less. The BET method is one of the methods for measuring the specific surface area of powder using gas phase adsorption, in which the total surface area of 1 g of a sample powder, that is, specific surface area, is determined using the adsorption isotherm of the powder. In the BET method, in general, nitrogen gas is used as adsorption gas, and the amount of adsorbed gas is determined from the variation in pressure or volume of the adsorbed gas. The most famous equation expressing the isotherm of multimolecular adsorption is Brunauer, Emmett and Teller equation. This is called the BET equation and widely used for determining specific surface area. In the BET method, the specific surface area of powder particles is determined by multiplying the amount of adsorption calculated according to the BET equation by the area occupied by one molecule of the adsorption gas. More specifically, in a measurement using nitrogen adsorption/desorption, amounts of adsorption are measured for different relative pressures, and the gradient and intercept of the plots are calculated by the least square method, thus determining specific surface area. In the embodiments disclosed herein, the relationship between the relative pressure and the amount of adsorption is measured at five points for determining the specific surface area of a sample.

The hydrated alumina may be produced by a known method, such as hydrolysis of aluminum alkoxide or sodium aluminate, as disclosed in U.S. Pat. Nos. 4,242,271 and 4,202,870. Alternatively, the hydrated alumina may be produced by neutralizing a sodium aluminate solution with an aqueous solution of aluminum sulfate or aluminum chloride. An example of the hydrated alumina is in the form of boehmite or amorphous when analyzed by X-ray diffraction analysis. For example, a commercially available hydrated alumina such as DISPERAL HP14 produced by Sasol may be used.

In the coating liquid (dispersion liquid) for the first ink receiving layer, the hydrated alumina desirably has an average particle size (secondary particle size) in the range of 50 nm to 300 nm, preferably in the range of 100 nm to 200 nm.

Alumina and hydrated alumina may be mixed for use. For mixing, powders of alumina and hydrated alumina may be mixed with or dispersed in each other to prepare a dispersion liquid (sol), or a dispersion liquid of alumina and a dispersion liquid of hydrated alumina may be mixed. Average particle size (secondary particle size) of the alumina and hydrated alumina in the dispersion liquid is desirably in the range of 50 nm to 300 nm, preferably in the range of 100 nm to 200 nm.

The average particle size (secondary particle size) of the alumina and hydrated alumina in the dispersion liquid can be measured by dynamic light scattering. More specifically, the average particle size of the alumina and hydrated alumina may be determined by measuring the dispersion liquid diluted with water with a particle size distribution analyzer ELSZ series of Otsuka Electronics, such as ELSZ-1 or ELSZ-2.

Fumed Silica

Fumed silica is a type of silica produced in a dry process (gas phase process). More specifically, fumed silica, which may called dry silica, can be produced, for example, by burning silicon tetrachloride, hydrogen and oxygen. A commercially available fumed silica, such as AEROSIL 300 (produced by EVONIK) is an example of the fumed silica.

The BET specific surface area of the fumed silica is desirably 50 $m^2/g$ or more, preferably 200 $m^2/g$ or more, from the viewpoint of increasing ink absorbency and color developability (image density), and preventing cracks (preventing cracks produced particularly during drying after applying the coating liquid. Also, the BET specific surface area of the fumed silica is desirably 400 $m^2/g$ or less, preferably 350 $m^2/g$ or less. The BET specific surface area of the fumed silica is measured in the same manner as that of the hydrated alumina.

In the coating liquids (dispersion liquids) for the first, the second and the third ink receiving layer, the fumed silica desirably has an average particle size (secondary particle size) in the range of 50 nm to 300 nm, preferably in the range of 100 nm to 200 nm. The average particle size (secondary particle size) of the fumed silica in a dispersion liquid can be measured by dynamic light scattering as in the case of measuring the average particle sizes of alumina and hydrated alumina.

The average particle sizes (secondary particle sizes) of the first, the second and the third inorganic pigment are each desirably in the range of 50 nm to 300 nm.

Polyvinyl Alcohol

The polyvinyl alcohol may be produced by hydrolysis of poly(vinyl acetate). The polyvinyl alcohol desirably has a viscosity average polymerization degree in the range of 2000 to 4500, preferably in the range of 3000 to 4000. The polyvinyl alcohol having a viscosity average polymerization degree in the range of 2000 to 4500 helps to increase fold crack resistance, ink absorbency and image density, and to prevent the ink receiving layer from being cracked when the coating liquid is applied. Desirably, the polyvinyl alcohol is fully or partially saponified. The saponification degree of the polyvinyl alcohol is desirably in the range of 85% by mole to 100% by mole. For example, PVA 235 (produced by Kuraray), having a saponification degree of 88% by mole and an average polymerization degree of 3500, may be used as the polyvinyl alcohol.

Before the polyvinyl alcohol is added to the coating liquid, it may be dissolved or dispersed in water, and such a polyvinyl alcohol-containing aqueous solution may be added. In this instance, the solid content of polyvinyl alcohol in the polyvinyl alcohol-containing aqueous solution is desirably in the range of 4.0% by mass to 15.0% by mass. When the solid content of polyvinyl alcohol in the aqueous solution is 4.0% by mass or more, the density of the coating liquid does not decrease excessively. Thus the addition of such an aqueous solution prevents the decrease in drying speed of the coating liquid. When the solid content of polyvinyl alcohol in the aqueous solution is 15.0% by mass or less, the density of the coating liquid does not increase to such an extent that the viscosity of the coating liquid increases excessively. Thus the addition of such an aqueous solution prevents the degradation of the smoothness of the surface of the coating.

The ink receiving layer may further contain another binder, in addition to the polyvinyl alcohol, if necessary. In order to satisfactorily produce an intended effect, however, the content of such an additional binder, other than polyvinyl alcohol, is desirably 50.0 parts by mass or less relative to 100 parts by mass of the polyvinyl alcohol.

Boric Acid Compound

The ink receiving layer contains a boric acid compound as a crosslinking agent for the polyvinyl alcohol. The boric acid compound may be a borate. Examples of the boric acid compound include orthoboric acid ($H_3BO_3$), metaboric acid, hypoboric acid, and salts thereof. Salts of the boric acid compound include orthoborates, such as $InBO_3$, $ScBO_3$, $YBO_3$, $LaBO_3$, $Mg_3(BO_3)_2$, and $Co_3(BO_3)_2$; diborates, such as $Mg_2B_2O_5$ and $Co_2B_2O_5$; metaborates, such as $LiBO_2$, $Ca(BO_2)_2$. $NaBO_2$, and $KBO_2$; tetraborates, such as borax $Na_2B_4O_7.10H_2O$; pentaborates, such as $KB_5O_8.4H_2O$ and $CsB_5O_5$; hexaborates, such as $Ca_2B_6O_{11}.7H_2O$; and hydrates of these salts. Among these boric acid compounds, orthoboric acid is advantageous from the viewpoint of the stability of the coating liquid with time. Although boric acid compounds may be used singly or in combination, orthoboric acid is used desirably in a proportion in the range of 80% by mass to 100% by mass, preferably in the range of 90% by mass to 100% by mass, to the total amount of the boric acid compounds used.

For preparing the coating liquids of the ink receiving layers, the boric acid compound may be dissolved or dispersed in water, and such a boric acid compound-containing aqueous solution may be added to the coating liquid. In this instance, the solid content of the boric acid compound in the boric acid compound-containing aqueous solution is desirably in the range of 0.5% by mass to 8.0% by mass. When the solid content of the boric acid compound in the aqueous solution is 0.5% by mass or more, the density of the coating liquid does not decrease excessively. Thus the addition of such an aqueous solution prevents the decrease in drying speed of the coating liquid. When the solid content of the boric acid compound in the aqueous solution is 8.0% by mass or less, the boric acid compound is unlikely to precipitate.

Additives

Each ink receiving layer may contain additives as needed. Additives include a fixing agent such as a cationic polymer, a flocculant such as a polyvalent metal salt, a surfactant, a fluorescent brightening agent, a thickener, an antifoaming agent, a foam suppressor, a release agent, a penetrant, a lubricant, an ultraviolet absorbent, an antioxidant, a levelling agent, a preservative, and a pH adjuster.

Each of the first, the second and the third ink receiving layer will now be described in detail.

First Ink Receiving Layer

In the first ink receiving layer, the boric acid compound content is in the range of 2.0 parts by mass to 7.0 parts by mass relative to 100 parts by mass of the polyvinyl alcohol. The use of a boric acid compound in this range can prevent the ink receiving layer from cracking and, in addition, increase the fold crack resistance of the ink receiving layer. Preferably, the boric acid compound content in the first ink receiving layer is in the range of 2.3 parts by mass to 6.9 parts by mass, such as in the range of 3.0 parts by mass to 6.5 parts by mass, relative to 100 parts by mass of the polyvinyl alcohol.

The first ink receiving layer also contains at least one inorganic pigment, as a first inorganic pigment, selected from the group consisting of alumina, hydrated alumina and fumed silica. Hydrated alumina has a higher surface hydroxyl density than fumed silica or alumina, and has a high binding force with polyvinyl alcohol. Accordingly, the hydrated alumina content in the first inorganic pigment is desirably 50.0% by mass or more, such as 80% by mass or more, in view of fold crack resistance, and is preferably 100% by mass. Also, the first inorganic pigment desirably accounts for 90% by mass or more, preferably 100% by mass, of the total mass of the inorganic pigments in the first ink receiving layer.

The first inorganic pigment content in the first ink receiving layer is desirably in the range of 50% by mass to 90% by mass, and is preferably in the range of 65% by mass to 90% by mass.

In the first ink receiving layer, the polyvinyl alcohol content is desirably in the range of 11.0 parts by mass to 40.0 parts by mass, preferably in the range of 12.0 parts by mass to 30.0 parts by mass, relative to 100 parts by mass of the first inorganic pigment. The use of polyvinyl alcohol with such a content can prevent the occurrence of cracks and increase ink absorbency and fold crack resistance.

The polyvinyl alcohol content in the first ink receiving layer is desirably in the range of 9% by mass to 28% by mass, and is preferably in the range of 10% by mass to 23% by mass.

The first ink receiving layer desirably has a thickness in the range of 10.0 μm to 40.0 μm, preferably in the range of 13.0 μm to 32.5 μm, such as 25.0 μm to 30.0 μm.

Second Ink Receiving Layer

In the second ink receiving layer, the proportion of the boric acid compound content to the polyvinyl alcohol content is higher than that in the first ink receiving layer. The boric acid compound content in the second ink receiving layer is in the range of 10.0 parts by mass to 30.0 parts by mass relative to 100 parts by mass of the polyvinyl alcohol. By setting the content of the crosslinking agent, or boric acid compound, in the second ink receiving layer, in this range, the degree of crosslinking of the polyvinyl alcohol in the second ink receiving layer increases relative to that in the first ink receiving layer. Consequently, the polyvinyl alcohol in the second ink receiving layer is unlikely to swell when ink is applied and helps increase ink absorbency. In addition, the occurrence of cracks while the coating liquid is applied or dried can be reduced. Preferably, the boric acid compound content in the second ink receiving layer is in the range of 13.6 parts by mass to 25.0 parts by mass relative to 100 parts by mass of the polyvinyl alcohol.

In the second ink receiving layer, the polyvinyl alcohol content is desirably in the range of 10.0 parts by mass to 22.0 parts by mass relative to 100 parts by mass of the second inorganic pigment (fumed silica), and is preferably in the range of 12.0 parts by mass to 20.0 parts by mass. The use of polyvinyl alcohol with a content in the range of 12.0 parts by mass to 20.0 parts by mass can prevent the occurrence of cracks synergistically with the effect of the crosslinking agent in the first ink receiving layer, and increase the ink absorbency and fold crack resistance.

The second ink receiving layer also contains fumed silica as a second inorganic pigment. The second inorganic pigment content in the second ink receiving layer is desirably in the range of 75% by mass to 85% by mass, and is preferably in the range of 78% by mass to 84% by mass. The second inorganic pigment desirably accounts for 90% by mass or more, preferably 100% by mass, of the total mass of the inorganic pigments in the second ink receiving layer.

The polyvinyl alcohol content in the second ink receiving layer is desirably in the range of 8% by mass to 17% by mass, and is preferably in the range of 10% by mass to 16% by mass.

The second ink receiving layer desirably has a thickness in the range of 2.5 μm to 25.0 μm, such as 5.0 μm to 20.0 μm, and preferably in the range of 6.0 μm to 17.5 μm.

The ratio of the thickness of the second ink receiving layer to the thickness of the first ink receiving layer is desirably in the range of 0.08 to 1.33, and is preferably in the range of 0.38 to 1.00. When the ratio of the thicknesses is in the range of 0.08 to 1.33, the fold crack resistance, ink absorbency, and cracking resistance (particularly during drying after applying the coating liquid) can be increased.

In the description herein, the thickness of a layer is evaluated in terms of average of the measurements at, for example, four points of the section of the layer observed through a scanning electron microscope.

Outermost Layer

In a first embodiment where the second ink receiving layer acts as the outermost layer, the second ink receiving layer further contains particles having an average particle size in the range of 1.0 μm to 20.0 μm. In this second ink receiving layer, the content of the particles having an average particle size in the range of 1.0 μm to 20.0 μm is in the range of 0.5 part by mass to 5.0 parts by mass relative to 100 parts by mass of the second inorganic pigment.

In a second embodiment, a third ink receiving layer acting as the outermost layer is disposed on the second ink receiving layer. In this instance, the third ink receiving layer contains particles having an average particle size in the range of 1.0 μm to 20.0 μm.

More specifically, the third ink receiving layer contains a fumed silica as a third inorganic pigment, particles having an average particle size in the range of 1.0 μm to 20.0 μm, polyvinyl alcohol, and a boric acid compound. In the third ink receiving layer, the content of the particles having an average particle size in the range of 1.0 μm to 20.0 μm is in the range of 0.5 part by mass to 5.0 parts by mass relative to 100 parts by mass of the third inorganic pigment.

The boric acid compound content in the third ink receiving layer is desirably in the range of 10.0 parts by mass to 30.0 parts by mass, preferably in the range of 12.0 parts by mass to 25.0 parts by mass, relative to 100 parts by mass of the polyvinyl alcohol.

In the third ink receiving layer, the polyvinyl alcohol content is desirably in the range of 10.0 parts by mass to 22.0 parts by mass, preferably in the range of 12.0 parts by mass to 20.0 parts by mass, relative to 100 parts by mass of the third inorganic pigment (fumed silica). The use of polyvinyl alcohol with a content of 12.0 parts by mass to 20.0 parts by mass can prevent the occurrence of cracks synergistically with the effect of crosslinking agent in the first and second ink receiving layers, and increase the ink absorbency and fold crack resistance. The third ink receiving layer also contains fumed silica as a third inorganic pigment. The third inorganic pigment content in the third ink receiving layer is desirably in the range of 75% by mass to 85% by mass, and is preferably in the range of 78% by mass to 84% by mass. The third inorganic pigment desirably accounts for 90% by mass or more, preferably 100% by mass, of the total mass of the inorganic pigments in the third ink receiving layer. The polyvinyl alcohol content in the third ink receiving layer is desirably in the range of 8% by mass to 17% by mass, and is preferably in the range of 10% by mass to 16% by mass.

The third ink receiving layer desirably has a thickness in the range of 0.1 μm to 10.0 μm, preferably in the range of 0.2 μm to 5.0 μm.

The outermost layer containing particles having an average particle size in the range of 1.0 μm to 20.0 μm enables the recording medium to have an appropriate smoothness for making it easy to turn pages. In a photo book using two-sided glossy paper sheets as the recording media which have the multilayer structure of an embodiment of the application at both sides of the medium, phenomena of sticking ink receiving layers together and of catching a page by friction and other phenomena likely to occur in photo books bound by side stitching without use of a mount or by adhesive binding are reduced effectively. The user thus can browse the photo book without feeling stress.

The particles having an average particle size in the range of 1.0 μm to 20.0 μm may be organic particles or inorganic particles. Preferably, the average particle size of the particles is in the range of 2.0 μm to 10.0 μm, such as 2.0 μm to 6.0 μm. The content of the particles is in the range of 0.5 part by mass to 5.0 parts by mass relative to 100 parts by mass of the second or third inorganic pigment in the outermost layer. The particles used with such a content helps increase the ease of page turning without reducing glossiness. Preferably, the content of the particles is in the range of 1.5 parts by mass to 4.0 parts by mass relative to 100 parts by mass of the second or third inorganic pigment in the outermost layer. The average particle size mentioned herein is defined by the average of diameters of 100 particles in the surface of the outermost layer randomly selected through an optical microscope.

The content of the particles in the outermost layer is desirably in the range of f 0.4% by mass to 4.0% by mass, and is preferably in the range of 1.0% by mass to 3.0% by mass.

The outermost layer desirably has a thickness in the range of 0.1 μm to 10 p.m.

Materials of organic particles include, but are not limited to, polyamide resin, polyester resin, polycarbonate resin, polyolefin resin, polysulfone resin, polystyrene resin, polyvinyl chloride resin, polyvinylidene chloride resin, polyphenylene sulfide resin, ionomer resin, acrylic resin, vinyl resin, urea resin, melamine resin, urethane resin, nylon, copolymers of these resins, cellulose-based compounds, and starch. Among these materials, polyolefin resin, polystyrene resin, acrylic resin, and starch are advantageous as the organic particles, and polyolefin resin is more advantageous. Although the organic particles may be in any shape, it is supposed that the more spherical the particles are, the more advantageous they are. Properly spherical particles are advantageous.

For inorganic particles, wet process silica may be advantageously used. Wet process silica may be precipitated silica or gel process silica. Precipitated silica may be produced by, for example, a reaction of sodium silicate with sulfuric acid under an alkaline condition. More specifically, precipitated silica can be produced by aggregating grown silica particles to precipitate, followed by filtering, rinsing, drying, pulverizing and classifying the precipitated particles. The secondary particles of the silica produced in this process are relatively easy to pulverize. Precipitated silica can be commercially available, for example, as NIPSIL from Tosoh Silica or as TOKUSAIL or FINESIL from Tokuyama. More specifically, examples of precipitated silica include NIPSIL K-500 (produced by Tosoh Silica), FINESIL X-37 (produced by Tokuyama), FINESIL X-37B (produced by Tokuyama), and FINESIL X-45 (produced by Tokuyama).

Gel process silica may be produced by, for example, a reaction of sodium silicate with sulfuric acid under an acid condition. This process allows silica particles to aggregate while suppressing the growth of primary particles, thus producing aggregated particles among which primary particles are bound tightly. Gel process silica is available, for example, as MIZUKASIL from Mizusawa Industrial Chemicals or as SYLOJET from Grace Japan. More specifically, examples of gel process silica include MIZUKASIL P-707 (produced by Mizusawa Industrial Chemicals) and MIZUKASIL P78A (produced by Mizusawa Industrial Chemicals).

Wet process silica particles normally have anionic surfaces and have high affinity with fumed silica. Accordingly, wet process silica can be used with the anionic surfaces thereof maintained. Wet process silica may be cationized with a cationic polymer.

In any embodiment of the present application, the particles in the layers other than the outermost layer do not much contribute to increasing the ease of page turning. Accordingly, the content of the particles having an average particle size in the range of 1.0 μm to 20.0 μm in the ink receiving layer(s) other than the outermost layer may be so low as the proportion thereof to 100 parts by mass of the inorganic pigment is 0.1 part by mass or less, such as 0.01 part by mass or less. Advantageously, the ink receiving layer(s) other than outermost layer does not contain the particles.

Coating liquids for Ink Receiving Layers

Sol Containing at Least One of Alumina, Hydrated Alumina and Fumed Silica

For adding alumina or hydrated alumina to the coating liquid for an ink receiving layer, it is advantageous to deflocculate the alumina or hydrated alumina with a flocculant in a dispersion liquid before adding. The dispersion liquid containing alumina or hydrated alumina deflocculated with a deflocculant is referred to as alumina sol or hydrated alumina sol. The sol containing at least one of alumina and hydrated alumina may further contain an acid as a deflocculant in addition to the alumina or hydrated alumina. The sol may also contain other additives, such as a dispersion medium, a pigment dispersing agent, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water resistant additive, a dye fixing agent, a crosslinking agent, and a weather-resistant material. The dispersion medium in the sol containing at least one of alumina or hydrated alumina may be water, an organic solvent, or a mixture thereof, and water is advantageous. Acids are suitable as the deflocculant. Acids used as deflocculant are called deflocculating acids.

In an embodiment, it is advantageous to use a hydrated alumina sol containing an alkylsulfonic acid having a carbon number of 1 to 4 as a deflocculating acid. Hence, it is advantageous that the first ink receiving layer contains an alkylsulfonic acid having a carbon number in the range of 1 to 4. Deflocculants may be used singly or in combination.

The use of an alkylsulfonic acid having a carbon number of 4 or less or a sulfonic acid having a benzene ring as the deflocculant helps increase color stability, moisture resistance and image density. This is probably because a deflocculant having a lower carbon number is less hydrophobic and accordingly makes the surfaces of hydrated alumina particles less hydrophobic, consequently increasing the fixing rate of dye at the surfaces of the hydrated alumina particles. Also, hydrated alumina particles deflocculated with an alkylsulfonic acid having a carbon number of 4 or less or a sulfonic acid having a benzene ring can exhibit particularly satisfactory dispersion stability and suppresses the increase in viscosity of the dispersion liquid. Furthermore, aggregation of hydrated alumina particles can be prevented, and accordingly image density can increase.

The alkylsulfonic acid having a carbon number in the range of 1 to 4 may be a monobasic acid containing only a sulfo group as a solubilizing group. Desirably, the alkyl chain of the monobasic alkylsulfonic acid is unsubstituted and has a carbon number in the range of 1 to 4. The alkyl chain may be linear or branched. Exemplary alkylsulfonic acids include methanesulfonic acid, ethanesulfonic acid, isopropanesulfonic acid, n-propanesulfonic acid, n-butanesulfonic acid, isobutanesulfonic acid, and t-butanesulfonic acid. Among these, advantageous alkylsulfonic acids are methanesulfonic acid, ethanesulfonic acid, isopropanesulfonic acid, and n-propanesulfonic acid. Methanesulfonic acid is the most advantageous. Two or more alkylsulfonic acids having a carbon number of 1 to 4 may be used in combination.

The proportion of the alkylsulfonic acid used may be in the range of 1.0 part by mass to 2.0 parts by mass relative to 100 parts by mass of hydrated alumina. The use of an alkylsulfonic acid in such a proportion helps increase resistance to moisture and ozone. When the alkylsulfonic acid is used in a proportion of 2.0 parts by mass or less, ink absorbency tends to increase. The alkylsulfonic acid content is preferably 1.3% by mass or more and 1.6% by mass or less relative to 100% by mass of hydrated alumina.

Sol Containing Fumed Silica

For adding fumed silica to the coating liquid for an ink receiving layer, it is advantageous to disperse the fumed silica in a dispersion liquid before adding. The dispersion containing fumed silica is referred to as a fumed silica sol. The fumed silica sol contains a cationic polymer as a mordant. Examples of the cationic polymer include polyethyleneimine resin, polyamide resin, polyamide-epichlorohydrin resin, polyamine-epichlorohydrin resin, polyamide polyamine epichlorohydrin resin, polydiallylamine resin, and dicyandiamide condensates. These cationic polymers may be used singly or in combination. The fumed silica sol may further contain a polyvalent metal salt. The polyvalent metal salt may be an aluminum compound, such as polyaluminum chloride, poly(aluminum acetate), and poly(aluminum lactate). The fumed silica sol may also contain other additives, such as a silane coupling agent or any other surface modifier, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water resistant additive, a crosslinking agent, and a weather-resistant material. The dispersion medium of the fumed silica sol may be water, an organic solvent, or a mixture thereof. Water is advantageous.

Process for Applying Coating Liquid for Ink Receiving Layer

The ink receiving layers may be formed by applying the respective coating liquids thereof and drying the coating. The coating liquid may be applied by a known method. For example, the coating liquid is applied by slot die coating, slide bead coating, curtain coating, extrusion coating, air knife coating, roll coating, or rod bar coating. The coating liquids for the first and second ink receiving layers may be applied and dried one after the other, or may be applied simultaneously. Slide bead coating is highly productive and is therefore advantageous.

For drying the applied coating liquid, a dryer may be used. The examples of the dryer include hot air dryers, such as a linear tunnel dryer, an arch dryer, an air loop dryer, and a sine curve air flow dryer; and other types such as an IR dryer, a heating dryer, and a microwave dryer.

EXAMPLES

The present application will be further described in detail with reference to Examples, but is not limited to the examples. In the following description, the term "part(s)" refers to "part(s) by mass".

Preparation of Water-Resistant Substrate

A pulp containing 80 parts of leaf bleached kraft pulp (LBKP) having a freeness of 450 mL CSF (Canadian Standard Freeness) and 20 parts of needle bleached kraft pulp (NBKP) having a freeness of 480 mL CSF was prepared. To this pulp added were 0.60 part of cationized starch, 10 parts of ground calcium carbonate, 15 parts of precipitated calcium carbonate, 0.10 part of alkylketene dimer, and 0.03 part of cationic polyacrylamide. Then water was further added to the mixture so that the resulting paper stock has a solid content of 3.0% by mass. Subsequently, a sheet of paper was made of the paper stock with a Fourdrinier machine, followed by three-step wet press and drying with a multicylinder dryer. Then, the resulting sheet was soaked with an aqueous solution of oxidized starch in an amount of 1.0 g/m$^2$, followed by drying. The sheet was then finished by machine calendering to yield a base paper having a basis weight of 155 g/m$^2$.

A resin composition containing 70 parts of a low-density polyethylene, 20 parts of a high-density polyethylene and 10 parts of titanium oxide was applied to both sides of the base paper, thereby forming resin layers each having to a thickness of 25.0 μm. Immediately after the formation of the resin layers, each resin layers was subjected to shaping to form a glossy surface with a cooling roller having a mirror-finished surface. After the resulting resin layers were subjected to corona discharge, an acid-treated gelatin was applied to the surface of each resin layer so that 0.05 g/m$^2$ of solid would be applied, thus forming an adhesion facilitating layer.

Thus water-resistant substrates for two-sided glossy paper were prepared for the Examples.

Preparation of Hydrated Alumina Sol

To 333 parts of ion exchanged water, 1.5 parts of methanesulfonic acid was added as a deflocculating acid to prepare a methanesulfonic acid aqueous solution. While the methanesulfonic acid aqueous solution was stirred with a homogenizing mixer (T.K. Homo Mixer MARK II model 2.5, manufactured by Primix) at 3000 rpm, 100 parts of hydrated alumina (DISPERAL HP14, produced by Sasol) was slowly added to the methanesulfonic acid aqueous solution. After the completion of the addition, the solution was further stirred for 30 minutes, thus yielding a hydrated alumina sol with a solid content of 23.0% by mass. The average particle size of the hydrated alumina particles in the sol was measured with ELSZ-2 manufactured by Otsuka Electronics. The average particle size of the hydrated alumina particles was 160 nm.

Preparation of Alumina Sol

To 333 parts of ion exchanged water, 1.5 parts of methanesulfonic acid was added as deflocculating acid to prepare a methanesulfonic acid aqueous solution. While the methanesulfonic acid aqueous solution was stirred with a homogenizing mixer (T.K. Homo Mixer MARK II model 2.5, manufactured by Primix) at 3000 rpm, 100 parts of alumina (AEROXIDE Alu C, produced by EVONIK) was slowly added to the methanesulfonic acid aqueous solution. After the completion of the addition, the solution was further stirred for 30 minutes, thus yielding an alumina sol with a solid content of 23.0% by mass. The average particle size of the alumina particles in the sol was measured with ELSZ-2 manufactured by Otsuka Electronics. The average particle size of the alumina particles was 180 nm.

Preparation of Fumed Silica Sol

To 333 parts of ion exchanged water, 4.0 parts of a cationic polymer (SHALLOL DC-902P, produced by Daiichi Kogyo Seiyaku) was added to prepare a cationic polymer aqueous solution. While the cationic polymer aqueous solution was stirred with a homogenizing mixer (T.K. Homo Mixer MARK II model 2.5, manufactured by Primix) at 3000 rpm, 100 parts of fumed silica (AEROSIL 300, produced by EVONIK) was slowly added to the cationic polymer aqueous solution. After the completion of the addition, the polymer solution was diluted with ion exchanged water and further treated twice with a high-pressure homogenizer (Nanomizer, available from yoshida kikai), thus yielding a fumed silica sol with a solid content of 20.0% by mass. The average particle size of the fumed silica particles in the sol was measured with ELSZ-2 manufactured by Otsuka Electronics. The average particle size of the fumed silica particles was 150 nm.

Preparation of Polyvinyl Alcohol-Containing Aqueous Solution

To 1150 parts of ion exchanged water, 100 parts of polyvinyl alcohol (PVA 235, produced by Kuraray, saponification degree: 88%, average polymerization degree: 3500) was added with stirring. After the completion of the addition, polyvinyl alcohol was dissolved in the ion exchanged water at 90° C. to yield a polyvinyl alcohol-containing aqueous solution with a solid content of 8.0% by mass.

Preparation of Recording Medium 1

Coating Liquid 1 for Second Ink Receiving Layer

To the fumed silica sol, wet process silica (FINESIL X-37B, produced by Tokuyama, average particle size: 3.7 μm) was added so that the solid content of the wet process silica would be 2.0 parts relative to 100 parts of the fumed silica in terms of solid content. Subsequently, the polyvinyl alcohol-containing aqueous solution was added to the fumed silica sol containing the wet process silica so that the solid content of the polyvinyl alcohol would be 17.0 parts relative to 100 parts of the fumed silica in terms of solid content. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 1 for the second ink receiving layer (hereinafter referred to as second ink receiving layer coating liquid 1).

Coating Liquid 1 for First Ink Receiving Layer

The polyvinyl alcohol-containing aqueous solution was added to the hydrated alumina sol so that the solid content of the polyvinyl alcohol would be 13.0 parts relative to 100 parts of the hydrated alumina in terms of solid content. Then, the orthoboric acid-containing aqueous solution with a solid content of 5.0% by mass was added to the resulting mixture so that the solid content of the orthoboric acid would be 5.8 parts relative to 100 parts of the polyvinyl alcohol in terms of solid content, and thus coating liquid 1 for the first ink receiving layer (hereinafter referred to as first ink receiving layer coating liquid 1) was prepared.

Formation of Ink Receiving Layers

Second ink receiving layer coating liquid 1 and first ink receiving layer coating liquid 1 were simultaneously applied to both sides of the substrate. In this coating operation, the coating liquids were applied with a multilayer slide hopper coater so that the first ink receiving layer and the second ink receiving layer would have thicknesses of 25.0 μm and 10.0 μm, respectively (total thickness of 35.0 μm) when subjected to bone dry. Subsequently, the coated substrate was dried at 60° C. to yield recording medium 1. The resulting recording medium had a structure including the substrate, a first ink receiving layer, and a second ink receiving layer (outermost layer) in that order. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 2

Recording medium 2 was prepared in the same manner as recording medium 1 except that the first ink receiving layer coating liquid 1 was replaced with the following coating liquid 2 for the first ink receiving layer (hereinafter referred to as first ink receiving layer coating liquid 2). The particle sizes of 100 wet process silica particles randomly sampled from the surface of the recording medium were measured, and thus the average particle size thereof was calculated. The average particle size of the wet process silica particles was 3.0 μm.

Coating Liquid 2 for First Ink Receiving Layer

The polyvinyl alcohol-containing aqueous solution was added to the fumed silica sol so that the solid content of the polyvinyl alcohol would be 30.0 parts relative to 100 parts of the fumed silica in terms of solid content. Then, the orthoboric acid-containing aqueous solution with a solid content of 5.0% by mass was added to the resulting mixture so that the solid content of the orthoboric acid would be 5.8 parts relative to 100 parts of the polyvinyl alcohol in terms of solid content, and thus first ink receiving layer coating liquid 2 was prepared.

Preparation of Recording Medium 3

Recording medium 3 was prepared in the same manner as recording medium 1 except that the first ink receiving layer coating liquid 1 was replaced with the following coating liquid 3 for the first ink receiving layer (hereinafter referred to as first ink receiving layer coating liquid 3). The particle sizes of 100 wet process silica particles randomly sampled from the surface of the recording medium were measured, and thus the average particle size thereof was calculated. The average particle size of the wet process silica particles was 3.0 μm.

Coating Liquid 3 for First Ink Receiving Layer

The hydrated alumina sol and the fumed silica sol were mixed so that the ratio of the solid content of hydrated alumina to the solid content of fumed silica would be 25:75. Subsequently, the polyvinyl alcohol-containing aqueous solution was added to the mixed sol so that the solid content of the polyvinyl alcohol would be 25.0 parts relative to 100 parts of the total mass of the hydrated alumina and the fumed silica in terms of solid content. Then, the orthoboric acid-containing aqueous solution with a solid content of 5.0% by mass was added to the resulting mixture so that the solid content of the orthoboric acid would be 5.8 parts relative to 100 parts of the polyvinyl alcohol in terms of solid content, and thus first ink receiving layer coating liquid 3 was prepared.

Preparation of Recording Medium 4

Recording medium 4 was prepared in the same manner as recording medium 1 except that the first ink receiving layer coating liquid 1 was replaced with the following coating liquid 4 for the first ink receiving layer (hereinafter referred to as first ink receiving layer coating liquid 4). The particle sizes of 100 wet process silica particles randomly sampled from the surface of the recording medium were measured, and thus the average particle size thereof was calculated. The average particle size of the wet process silica particles was 3.0 μm.

Coating Liquid 4 for First Ink Receiving Layer

The hydrated alumina sol and the fumed silica sol were mixed so that the ratio of the solid content of hydrated alumina to the solid content of fumed silica would be 75:25. Subsequently, the polyvinyl alcohol-containing aqueous solution was added to the mixed sol so that the solid content of the polyvinyl alcohol would be 18.0 parts relative to 100 parts of the total solid content of the hydrated alumina and the fumed silica. Then, the orthoboric acid-containing aqueous solution with a solid content of 5.0% by mass was added to the resulting mixture so that the solid content of the orthoboric acid would be 5.8 parts relative to 100 parts of the polyvinyl alcohol in terms of solid content, and thus first ink receiving layer coating liquid 4 was prepared.

Preparation of Recording Medium 5

Recording medium 5 was prepared in the same manner as recording medium 1 except that the first ink receiving layer coating liquid 1 was replaced with the following coating liquid 5 for the first ink receiving layer (hereinafter referred to as first ink receiving layer coating liquid 5 ). The particle sizes of 100 wet process silica particles randomly sampled from the surface of the recording medium were measured, and thus the average particle size thereof was calculated. The average particle size of the wet process silica particles was 3.0 μm.

Coating Liquid 5 for First Ink Receiving Layer

The hydrated alumina sol and the alumina sol were mixed so that the ratio of the solid content of hydrated alumina to the solid content of alumina would be 25:75. Subsequently, the polyvinyl alcohol-containing aqueous solution was added to the mixed sol so that the solid content of the polyvinyl alcohol would be 13.0 parts relative to 100 parts of the total mass of the hydrated alumina and the alumina in terms of solid content. Then, the orthoboric acid-containing aqueous solution with a solid content of 5.0% by mass was added to the resulting mixture so that the solid content of the orthoboric acid would be 5.8 parts relative to 100 parts of the polyvinyl alcohol in terms of solid content, and thus first ink receiving layer coating liquid 5 was prepared.

Preparation of Recording Medium 6

Recording medium 6 was prepared in the same manner as recording medium 1 except that the first ink receiving layer coating liquid 1 was replaced with the following coating liquid 6 for the first ink receiving layer (hereinafter referred to as first ink receiving layer coating liquid 6). The particle sizes of 100 wet process silica particles randomly sampled from the surface of the recording medium were measured, and thus the average particle size thereof was calculated. The average particle size of the wet process silica particles was 3.0 μm.

Coating Liquid 6 for First Ink Receiving Layer

The hydrated alumina sol and the alumina sol were mixed so that the ratio of the solid content of hydrated alumina to the solid content of alumina would be 75:25. Subsequently, the polyvinyl alcohol-containing aqueous solution was added to the mixed sol so that the solid content of the polyvinyl alcohol would be 13.0 parts relative to 100 parts of the total mass of the hydrated alumina and the alumina in terms of solid content. Then, the orthoboric acid-containing aqueous solution with a solid content of 5.0% by mass was added to the resulting mixture so that the solid content of the orthoboric acid would be 5.8 parts relative to 100 parts of the polyvinyl alcohol in terms of solid content, and thus first ink receiving layer coating liquid 6 was prepared.

Preparation of Recording Medium 7

Recording medium 7 was prepared in the same manner as recording medium 1 except that coating liquids were applied so that the second ink receiving layer and the first ink receiving layer would have thicknesses of 5.0 μm and 13.0 μm, respectively (total thickness of 18.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 8

Recording medium 8 was prepared in the same manner as recording medium 1 except that coating liquids were applied so that the second ink receiving layer and the first ink receiving layer would have thicknesses of 6.0 μm and 14.0 μm, respectively (total thickness of 20.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 9

Recording medium 9 was prepared in the same manner as recording medium 1 except that coating liquids were applied so that the second ink receiving layer and the first ink receiving layer would have thicknesses of 12.0 μm and 28.0 μm, respectively (total thickness of 40.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 10

Recording medium 10 was prepared in the same manner as recording medium 1 except that coating liquids were applied so that the second ink receiving layer and the first ink receiving layer would have thicknesses of 13.0 μm and 30.0 μm, respectively (total thickness of 43.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 11

Recording medium 11 was prepared in the same manner as recording medium 1 except that coating liquids were applied so that the second ink receiving layer and the first ink receiving layer would have thicknesses of 2.5 μm and 32.5 μm, respectively (total thickness of 35.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 12

Recording medium 12 was prepared in the same manner as recording medium 1 except that coating liquids were applied so that the second ink receiving layer and the first ink receiving layer would have thicknesses of 5.0 μm and 30.0 μm, respectively (total thickness of 35.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 13

Recording medium 13 was prepared in the same manner as recording medium 1 except that coating liquids were applied so that the second ink receiving layer and the first ink receiving layer would have thicknesses of 17.5 μm and 17.5 μm, respectively (total thickness of 35.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 14

Recording medium 14 was prepared in the same manner as recording medium 1 except that coating liquids were applied so that the second ink receiving layer and the first ink receiving layer would have thicknesses of 20.0 μm and 15.0 μm, respectively (total thickness of 35.0 μm). The particle sizes of 100 wet process silica particles randomly sampled from the surface of the recording medium were measured, and thus the average particle size thereof was calculated. The average particle size of the wet process silica particles was 3.0 μm.

Preparation of Recording Medium 15

Recording medium 15 was prepared in the same manner as recording medium 1 except that the coating liquid for the second ink receiving layer was prepared by adding the orthoboric acid-containing aqueous solution with a solid content of 5.0% by mass to the mixture so that the solid content of the orthoboric acid would be 10.0 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 16

Recording medium 16 was prepared in the same manner as recording medium 1 except that the coating liquid for the second ink receiving layer was prepared by adding the orthoboric acid-containing aqueous solution with a solid content of 5.0% by mass so that the solid content of the orthoboric acid would be 30.0 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 17

The coating liquid for the second ink receiving layer was prepared in the same manner as second ink receiving layer coating liquid 1 of recording medium 1 except that the polyvinyl alcohol-containing aqueous solution with a solid content of 8.0% by mass was added so that the solid content of polyvinyl alcohol would be 10.0 parts relative to 100 parts of fumed silica in terms of solid content. Then, the orthoboric acid-containing aqueous solution with a solid content of 5.0% by mass was added to the resulting mixture so that the solid content of the orthoboric acid would be 30.0 parts relative to 100 parts of the polyvinyl alcohol in terms of solid content, and thus a coating liquid was prepared. Recording medium 17 was thus prepared in the same manner as recording medium 1 except for the above-described points. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 18

The coating liquid for the second ink receiving layer was prepared in the same manner as second ink receiving layer coating liquid 1 of recording medium 1 except that the polyvinyl alcohol-containing aqueous solution with a solid content of 8.0% by mass was added so that the solid content of polyvinyl alcohol would be 12.0 parts relative to 100 parts of fumed silica in terms of solid content. Then, the orthoboric acid-containing aqueous solution with a solid content of 5.0% by mass was added to the resulting mixture so that the solid content of the orthoboric acid would be 25.0 parts relative to 100 parts of the polyvinyl alcohol in terms of solid content, and thus a coating liquid was prepared. Recording medium 18 was thus prepared in the same manner as recording medium 1 except for the above-described points. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 19

The coating liquid for the second ink receiving layer was prepared in the same manner as second ink receiving layer coating liquid 1 of recording medium 1 except that the polyvinyl alcohol-containing aqueous solution with a solid content of 8.0% by mass was added so that the solid content of polyvinyl alcohol would be 20.0 parts relative to 100 parts of fumed silica in terms of solid content. Then, the orthoboric acid-containing aqueous solution with a solid content of 5.0% by mass was added to the resulting mixture so that the solid content of the orthoboric acid would be 15.0 parts relative to 100 parts of the polyvinyl alcohol in terms of solid content, and thus a coating liquid was prepared. Recording medium 19 was thus prepared in the same manner as recording medium 1 except for the above-described points. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 20

The coating liquid for the second ink receiving layer was prepared in the same manner as second ink receiving layer coating liquid 1 of recording medium 1 except that the polyvinyl alcohol-containing aqueous solution with a solid content of 8.0% by mass was added so that the solid content of polyvinyl alcohol would be 22.0 parts relative to 100 parts of fumed silica in terms of solid content. Then, the orthoboric acid-containing aqueous solution with a solid content of 5.0% by mass was added to the resulting mixture so that the solid content of the orthoboric acid would be 13.6 parts relative to 100 parts of the polyvinyl alcohol in terms of solid content, and thus a coating liquid was prepared. Recording medium 20 was thus prepared in the same manner as recording medium 1 except for the above-described points. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 21

Recording medium 21 was prepared in the same manner as recording medium 1 except that the coating liquid for the first ink receiving layer was prepared by adding the orthoboric acid-containing aqueous solution with a solid content of 5.0% by mass so that the solid content of the orthoboric acid would be 2.3 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 22

Recording medium 22 was prepared in the same manner as recording medium 1 except that the coating liquid for the first ink receiving layer was prepared by adding the orthoboric acid-containing aqueous solution with a solid content of 5.0% by mass so that the solid content of the orthoboric acid would be 6.9 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 23

Recording medium 23 was prepared in the same manner as recording medium 2 except that the coating liquid for the first ink receiving layer was prepared by adding the orthoboric acid-containing aqueous solution with a solid content of 5.0% by mass so that the solid content of the orthoboric acid would be 2.3 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 24

Recording medium 24 was prepared in the same manner as recording medium 2 except that the coating liquid for the first ink receiving layer was prepared by adding the orthoboric acid-containing aqueous solution with a solid content of 5.0% by mass so that the solid content of the orthoboric acid would be 7.0 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 25

Recording medium 25 was prepared in the same manner as recording medium 3 except that the coating liquid for the first ink receiving layer was prepared by adding the orthoboric acid-containing aqueous solution with a solid content of 5.0% by mass so that the solid content of the orthoboric acid would be 2.4 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 26

Recording medium 26 was prepared in the same manner as recording medium 3 except that the coating liquid for the first ink receiving layer was prepared by adding the orthoboric acid-containing aqueous solution with a solid content of 5.0% by mass so that the solid content of the orthoboric acid would be 6.8 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 27

Recording medium 27 was prepared in the same manner as recording medium 4 except that the coating liquid for the first ink receiving layer was prepared by adding the orthoboric acid-containing aqueous solution with a solid content of 5.0% by mass to so that the solid content of the orthoboric acid would be 2.2 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 28

Recording medium 28 was prepared in the same manner as recording medium 4 except that the coating liquid for the first ink receiving layer was prepared by adding the orthoboric acid-containing aqueous solution with a solid content of 5.0% by mass to so that the solid content of the orthoboric acid would be 6.7 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 29

Recording medium 29 was prepared in the same manner as recording medium 1 except that the solid content of the polyvinyl alcohol in the coating liquid for the first ink receiving layer was adjusted to 10.0 parts relative to 100 parts of hydrated alumina in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 30

Recording medium 30 was prepared in the same manner as recording medium 1 except that the solid content of the polyvinyl alcohol in the coating liquid for the first ink receiving layer was adjusted to 11.0 parts relative to 100 parts of hydrated alumina in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 31

Recording medium 31 was prepared in the same manner as recording medium 1 except that the solid content of the polyvinyl alcohol in the coating liquid for the first ink receiving layer was adjusted to 40.0 parts relative to 100 parts of hydrated alumina in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 32

Recording medium 32 was prepared in the same manner as recording medium 1 except that the solid content of the polyvinyl alcohol in the coating liquid for the first ink receiving layer was adjusted to 42.0 parts relative to 100 parts of hydrated alumina in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 33

Recording medium 33 was prepared in the same manner as recording medium 2 except that the solid content of the polyvinyl alcohol in the coating liquid for the first ink receiving layer was adjusted to 10.0 parts relative to 100 parts of fumed silica in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 34

Recording medium 34 was prepared in the same manner as recording medium 2 except that the solid content of the polyvinyl alcohol in the coating liquid for the first ink receiving layer was adjusted to 11.0 parts relative to 100 parts of fumed silica in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 35

Recording medium 35 was prepared in the same manner as recording medium 2 except that the solid content of the polyvinyl alcohol in the coating liquid for the first ink receiving layer was adjusted to 40.0 parts relative to 100 parts of fumed silica in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 36

Recording medium 36 was prepared in the same manner as recording medium 2except that the solid content of the polyvinyl alcohol in the coating liquid for the first ink receiving layer was adjusted to 42.0 parts relative to 100 parts of fumed silica in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 37

Recording medium 37 was prepared in the same manner as recording medium 3 except that the coating liquid for the first ink receiving layer was prepared by adding polyvinyl alcohol to the mixed sol so that the solid content of the polyvinyl alcohol would be 10.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 38

Recording medium 38 was prepared in the same manner as recording medium 3 except that the coating liquid for the first ink receiving layer was prepared by adding polyvinyl alcohol to the mixed sol so that the solid content of the polyvinyl alcohol would be 11.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 39

Recording medium 39 was prepared in the same manner as recording medium 3 except that the coating liquid for the first ink receiving layer was prepared by adding polyvinyl alcohol to the mixed sol so that the solid content of the polyvinyl alcohol would be 40.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 40

Recording medium 40 was prepared in the same manner as recording medium 3 except that the coating liquid for the first ink receiving layer was prepared by adding polyvinyl alcohol to the mixed sol so that the solid content of the polyvinyl alcohol would be 42.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 41

Recording medium 41 was prepared in the same manner as recording medium 4except that the coating liquid for the first ink receiving layer was prepared by adding polyvinyl alcohol to the mixed sol so that the solid content of the polyvinyl alcohol would be 10.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 42

Recording medium 42 was prepared in the same manner as recording medium 4 except that the coating liquid for the first ink receiving layer was prepared by adding polyvinyl alcohol to the mixed sol so that the solid content of the polyvinyl alcohol would be 11.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 43

Recording medium 43 was prepared in the same manner as recording medium 4 except that the coating liquid for the first ink receiving layer was prepared by adding polyvinyl alcohol to the mixed sol so that the solid content of the polyvinyl alcohol would be 40.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 44

Recording medium 44 was prepared in the same manner as recording medium 4 except that the coating liquid for the first ink receiving layer was prepared by adding polyvinyl alcohol to the mixed sol so that the solid content of the polyvinyl alcohol would be 42.0 parts relative to 100 parts, in terms of solid content, of the total mass of the hydrated alumina and fumed silica in the mixed sol. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 45

The coating liquids for the second ink receiving layer and the first ink receiving layer were prepared in the same manner as second ink receiving layer coating liquid 1 and first ink receiving layer coating liquid 1, except that the polyvinyl alcohol in the polyvinyl alcohol-containing aqueous solution was replaced with a different polyvinyl alcohol (PVA 217 produced by Kuraray, saponification degree: 88%, average polymerization degree: 1700). Recording medium 45 l was thus prepared in the same manner as recording medium 1 except for the polyvinyl alcohol-containing aqueous solution. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 46

The coating liquids for the second ink receiving layer and the first ink receiving layer were prepared in the same manner as second ink receiving layer coating liquid 1 and first ink receiving layer coating liquid 1 of recording medium 1, except that the polyvinyl alcohol in the polyvinyl alcohol-containing aqueous solution was replaced with a different polyvinyl alcohol (PVA 424 produced by Kuraray, saponification degree: 80%, average polymerization degree: 2400). Recording medium 46 was thus prepared in the same manner as recording medium 1 except for the polyvinyl alcohol-containing aqueous solution. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 47

The coating liquids for the second ink receiving layer and the first ink receiving layer were prepared in the same manner as second ink receiving layer coating liquid 1 and first ink receiving layer coating liquid 1 of recording medium 1, except that the orthoboric acid-containing aqueous solution with a solid content of 5% by mass was replaced with a mixed solution with a total solid content of 5% by mass in which orthoboric acid and borax (sodium tetraborate) were dissolved in a solid content ratio of 75:25. Recording medium 47 was thus prepared in the same manner as recording medium 1 except for the above-described point.

Preparation of Recording Medium 48

Coating liquid 2 for Second Ink Receiving Layer To the fumed silica sol, wet process silica (FINESIL X-37B, produced by Tokuyama, average particle size: 3.7 μm) was mixed so that the solid content of the wet process silica would be 0.5 part relative to 100 parts of the fumed silica in terms of solid content. Subsequently, the polyvinyl alcohol-containing aqueous solution was further added so that the solid content of the polyvinyl alcohol would be 17.0 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 2 for the second ink receiving layer (hereinafter referred to as second ink receiving layer coating liquid 2).

Recording medium 48 was prepared in the same manner as recording medium 1 except that the second ink receiving layer coating liquid 1 was replaced with second ink receiving layer coating liquid 2. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 49

Coating Liquid 3 for Second Ink Receiving Layer

To the fumed silica sol, wet process silica (FINESIL X-37B, produced by Tokuyama, average particle size: 3.7 μm) was mixed so that the solid content of the wet process silica would be 5.0 parts relative to 100 parts of the fumed silica in terms of solid content. Subsequently, the polyvinyl alcohol-containing aqueous solution was further added so that the solid content of the polyvinyl alcohol would be 17.0 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 3 for the second ink receiving layer (hereinafter referred to as second ink receiving layer coating liquid 3).

Recording medium 49 was prepared in the same manner as recording medium 1 except that the second ink receiving layer coating liquid 1 was replaced with second ink receiving layer coating liquid 3. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 50

Coating Liquid 4 for Second Ink Receiving Layer

To the fumed silica sol, organic particles (crosslinked poly(methyl methacrylate), MBNX-8, average particle size: 5.0 μm, produced by Sekisuki Chemical) was mixed so that the solid content of the crosslinked poly(methyl methacrylate) would be 5.0 parts relative to 100 parts of the fumed silica in terms of solid content. Subsequently, the polyvinyl alcohol-containing aqueous solution was further added so that the solid content of the polyvinyl alcohol would be 17.0 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 4 for the second ink receiving layer (hereinafter referred to as second ink receiving layer coating liquid 4).

Recording medium 50 was prepared in the same manner as recording medium 1 except that the second ink receiving layer coating liquid 1 was replaced with second ink receiving layer coating liquid 4. The particle sizes of 100 organic particles randomly sampled from the surface of the recording medium were measured, and thus the average particle size thereof was calculated. The average particle size of the organic particles was 5.0 μm.

Preparation of Recording Medium 51

Coating Liquid 5 for Second Ink Receiving Layer

To the fumed silica sol, wet process silica (NIPGEL BY-001, produced by Tosoh Silica, average particle size: 20.0 μm) was mixed so that the solid content of the wet process silica would be 2.0 parts relative to 100 parts of the fumed silica in terms of solid content. Subsequently, the polyvinyl alcohol-containing aqueous solution was further added so that the solid content of the polyvinyl alcohol would be 17.0 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 5 for the second ink receiving layer (hereinafter referred to as second ink receiving layer coating liquid 5).

Recording medium 51 was prepared in the same manner as recording medium 1 except that the second ink receiving layer coating liquid 1 was replaced with second ink receiving layer coating liquid 5. The particle sizes of 100 wet process silica particles randomly sampled from the surface of the recording medium were measured, and thus the average particle size thereof was calculated. The average particle size of the wet process silica particles was 20.0 μm.

Preparation of Recording Medium 52

Coating Liquid 6 for Second Ink Receiving Layer

To the fumed silica sol, wet process silica (MIZUKASIL P-707M, produced by Mizusawa Industrial Chemicals, average particle size: 1.0 μm) was mixed so that the solid content of the wet process silica would be 2.0 parts relative to 100 parts of the fumed silica in terms of solid content. Subsequently, the polyvinyl alcohol-containing aqueous solution was further added so that the solid content of the polyvinyl alcohol would be 17.0 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 6 for the second ink receiving layer (hereinafter referred to as second ink receiving layer coating liquid 6).

Recording medium 52 was prepared in the same manner as recording medium 1 except that the second ink receiving layer coating liquid 1 was replaced with second ink receiving layer coating liquid 6. The particle sizes of 100 wet process silica particles randomly sampled from the surface of the recording medium were measured, and thus the average particle size thereof was calculated. The average particle size of the wet process silica particles was 1.0 μm.

Preparation of Recording Medium 53

Recording medium 53 was prepared in the same manner as recording medium 1 except that only a single layer of the second ink receiving layer was formed to a thickness of 35.0 μm. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 54

Recording medium 54 was prepared in the same manner as recording medium 1 except that only a single layer of the first ink receiving layer was formed to a thickness of 35.0 μm.

Preparation of Recording Medium 55

Recording medium 55 was prepared in the same manner as recording medium 2except that only a single layer of the first ink receiving layer was formed to a thickness of 35.0 μm.

Preparation of Recording Medium 56

Recording medium 56 was prepared in the same manner as recording medium 3 except that only a single layer of the first ink receiving layer was formed to a thickness of 35.0 μm.

Preparation of Recording Medium 57

Recording medium 57 was prepared in the same manner as recording medium 4except that only a single layer of the first ink receiving layer was formed to a thickness of 35.0 μm.

Preparation of Recording Medium 58

Recording medium 58 was prepared in the same manner as recording medium 1 except that second ink receiving layer coating liquid 1 and first ink receiving layer 1 were replaced with each other for coating.

Preparation of Recording Medium 59

Recording medium 59 was prepared in the same manner as recording medium 1 except that the orthoboric acid-containing aqueous solution was not added to second ink receiving layer coating liquid 1 and first ink receiving layer coating liquid 1. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 60

Recording medium 60 was prepared in the same manner as recording medium 1 except that the orthoboric acid-containing aqueous solution was not added to first ink receiving layer coating liquid 1. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 61

Recording medium 61 was prepared in the same manner as recording medium 1 except that the orthoboric acid-containing aqueous solution was not added to second ink receiving layer coating liquid 1. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 62

Recording medium 62 was prepared in the same manner as recording medium 1 except that the coating liquid for the second ink receiving layer was prepared by adding the orthoboric acid-containing aqueous solution with a solid content of 5.0% by mass so that the solid content of the orthoboric acid would be 32.4 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 63

Recording medium 63 was prepared in the same manner as recording medium 1 except that the coating liquid for the second ink receiving layer was prepared by adding the orthoboric acid-containing aqueous solution with a solid content of 5.0% by mass so that the solid content of the orthoboric acid would be 9.4 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 64

Recording medium 64 was prepared in the same manner as recording medium 1 except that the coating liquid for the first ink receiving layer was prepared by adding the orthoboric acid-containing aqueous solution with a solid content of 5.0% by mass so that the solid content of the orthoboric acid would be 1.5 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 65

Recording medium 65 was prepared in the same manner as recording medium 1 except that the coating liquid for the first ink receiving layer was prepared by adding the orthoboric acid-containing aqueous solution with a solid content of 5.0% by mass so that the solid content of the orthoboric acid would be 7.7 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 66

Recording medium 66 was prepared in the same manner as recording medium 2except that the coating liquid for the first ink receiving layer was prepared by adding the orthoboric acid-containing aqueous solution with a solid content of 5.0% by mass so that the solid content of the orthoboric acid would be 1.7 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 67

Recording medium 67 was prepared in the same manner as recording medium 2except that the coating liquid for the first ink receiving layer was prepared by adding the orthoboric acid-containing aqueous solution with a solid content of 5.0% by mass so that the solid content of the orthoboric acid would be 7.7 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 68

Recording medium 68 was prepared in the same manner as recording medium 3 except that the coating liquid for the first ink receiving layer was prepared by adding the orthoboric acid-containing aqueous solution with a solid content of 5.0% by mass so that the solid content of the orthoboric acid would be 1.6 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 69

Recording medium 69 was prepared in the same manner as recording medium 3 except that the coating liquid for the first ink receiving layer was prepared by adding the orthoboric acid-containing aqueous solution with a solid content of 5.0% by mass so that the solid content of the orthoboric acid would be 7.6 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 70

Recording medium 70 was prepared in the same manner as recording medium 4except that the coating liquid for the first ink receiving layer was prepared by adding the orthoboric acid-containing aqueous solution with a solid content of 5.0% by mass so that the solid content of the orthoboric acid would be 1.7 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 71

Recording medium 71 was prepared in the same manner as recording medium 4except that the coating liquid for the first ink receiving layer was prepared by adding the orthoboric acid-containing aqueous solution with a solid content of 5.0% by mass so that the solid content of the orthoboric acid would be 7.8 parts relative to 100 parts of the polyvinyl alcohol in terms of solid content. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 72

Coating Liquid 7 for Second Ink Receiving Layer

To the fumed silica sol, wet process silica (FINESIL X-37B, produced by Tokuyama, average particle size: 3.7 μm) was mixed so that the solid content of the wet process silica would be 0.3 part relative to 100 parts of the fumed silica in terms of solid content. Subsequently, the polyvinyl alcohol-containing aqueous solution was further added so that the solid content of the polyvinyl alcohol would be 17 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 7 for the second ink receiving layer (hereinafter referred to as second ink receiving layer coating liquid 7).

Recording medium 72 was prepared in the same manner as recording medium 1 except that the second ink receiving layer coating liquid 1 was replaced with second ink receiving layer coating liquid 7. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 73

Coating Liquid 8 for Second Ink Receiving Layer

To the fumed silica sol, wet process silica (FINESIL X-37B, produced by Tokuyama, average particle size: 3.7 μm) was mixed so that the solid content of the wet process silica would be 7.0 parts relative to 100 parts of the fumed silica in terms of solid content. Subsequently, the polyvinyl alcohol-containing aqueous solution was further added so that the solid content of the polyvinyl alcohol would be 17 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 8 for the second ink receiving layer (hereinafter referred to as second ink receiving layer coating liquid 8).

Recording medium 73 was prepared in the same manner as recording medium 1 except that the second ink receiving layer coating liquid 1 was replaced with second ink receiving layer coating liquid 8. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 74

Coating Liquid 9 for Second Ink Receiving Layer

To the fumed silica sol, wet process silica (MIZUKASIL P-707M, produced by Mizusawa Industrial Chemicals, average particle size: 35.0 μm) was mixed so that the solid content of the wet process silica would be 2.0 parts relative to 100 parts of the fumed silica in terms of solid content. Subsequently, the polyvinyl alcohol-containing aqueous solution was further added so that the solid content of the polyvinyl alcohol would be 17 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 9 for the second ink receiving layer (hereinafter referred to as second ink receiving layer coating liquid 9 ).

Recording medium 74 was prepared in the same manner as recording medium 1 except that the second ink receiving layer coating liquid 1 was replaced with second ink receiving layer coating liquid 9. The particle sizes of 100 wet process silica particles randomly sampled from the surface of the recording medium were measured, and thus the average particle size thereof was calculated. The average particle size of the wet process silica particles was 25.0 μm.

Preparation of Recording Medium 81

Coating Liquid 10 for Second Ink Receiving Layer

The polyvinyl alcohol-containing aqueous solution was added to the fumed silica sol so that the solid content of the polyvinyl alcohol would be 17.0 parts relative to 100 parts of the fumed silica in terms of solid content. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 10 for the second ink receiving layer (hereinafter referred to as second ink receiving layer coating liquid 10).

Coating Liquid 1 for Outermost Layer (Third Ink Receiving Layer)

To the fumed silica sol, wet process silica (FINESIL X-37B, produced by Tokuyama, average particle size: 3.7 μm) was mixed so that the solid content of the wet process silica would be 2.0 parts relative to 100 parts of the fumed silica in terms of solid content. Subsequently, the polyvinyl alcohol-containing aqueous solution was further added so that the solid content of the polyvinyl alcohol would be 17.0 parts. Then, the orthoboric acid-containing aqueous solution with a solid content of 5.0% by mass was added to the resulting mixture so that the solid content of the orthoboric acid would be 17.6 parts relative to 100 parts of the polyvinyl alcohol in terms of solid content, and thus a coating liquid for the second ink receiving layer was prepared. Furthermore, to the resulting coating liquid, a surfactant Surfinol 465 (produced by Nissin Chemical Industry) was added to a content of 0.1% by mass relative to the total mass of the coating liquid, thus yielding coating liquid 1 for the outermost layer (hereinafter referred to as outermost layer coating liquid 1).

Formation of Ink Receiving Layer

Outermost layer coating liquid 1, second ink receiving layer coating liquid 10 and first ink receiving layer coating liquid 1 were applied to both sides of the substrate. In this coating operation, the coating liquids were applied with a multilayer slide hopper coater so that the first ink receiving layer, the second ink receiving layer and the outermost layer (third ink receiving layer) would have thicknesses of 25.0 μm, 10.0 μm and 0.1 μm, respectively (total thickness of 35.1 μm) when subjected to bone dry. Subsequently, the coated substrate was dried at 60° C. to yield recording medium 81. The resulting recording medium 81 had the substrate, the first ink receiving layer, the second ink receiving layer and the outermost layer in that order when viewed from either side of the medium. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 82

Recording medium 82 was prepared in the same manner as recording medium 81 except that the outermost layer was formed to a thickness of 0.2 μm. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 83

Recording medium 83 was prepared in the same manner as recording medium 81 except that the outermost layer was formed to a thickness of 1.5 μm. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 84

Recording medium 84 was prepared in the same manner as recording medium 81 except that the outermost layer was formed to a thickness of 2.0 μm. The particle sizes of 100 wet process silica particles randomly sampled from the surface of the recording medium were measured, and thus the average particle size thereof was calculated. The average particle size of the wet process silica particles was 3.0 μm.

Preparation of Recording Medium 85

Recording medium 85 was prepared in the same manner as recording medium 81 except that the outermost layer was formed to a thickness of 5.0 μm. The particle sizes of 100 wet process silica particles randomly sampled from the surface of the recording medium were measured, and thus the average particle size thereof was calculated. The average particle size of the wet process silica particles was 3.0 μm.

The compositions of recording media 1 to 85 are shown in Table 1-1 and Tables 2 and 3.

TABLE 1-1

| | | Second ink receiving layer | | | | |
|---|---|---|---|---|---|---|
| | | | | Particles | | |
| | Recording medium | Polyvinyl alcohol content (parts by mass) to 100 parts by mass of second inorganic pigment | Boric acid content (parts by mass) to 100 parts by mass of polyvinyl alcohol | Type | Particle content (parts by mass) to 100 parts by mass of second inorganic pigment | Thickness (μm) |
| Example 1 | 1 | 17.0 | 17.6 | FINESIL | xxx2.0 | 10.0 |
| Example 2 | 2 | 17.0 | 17.6 | X-37B | | 10.0 |
| Example 3 | 3 | 17.0 | 17.6 | | | 10.0 |
| Example 4 | 4 | 17.0 | 17.6 | | | 10.0 |
| Example 5 | 5 | 17.0 | 17.6 | | | 10.0 |
| Example 6 | 6 | 17.0 | 17.6 | | | 10.0 |
| Example 7 | 7 | 17.0 | 17.6 | | | 5.0 |
| Example 8 | 8 | 17.0 | 17.6 | | | 6.0 |
| Example 9 | 9 | 17.0 | 17.6 | | | 12.0 |
| Example 10 | 10 | 17.0 | 17.6 | | | 13.0 |
| Example 11 | 11 | 17.0 | 17.6 | | | 2.5 |
| Example 12 | 12 | 17.0 | 17.6 | | | 5.0 |
| Example 13 | 13 | 17.0 | 17.6 | | | 17.5 |
| Example 14 | 14 | 17.0 | 17.6 | | | 20.0 |
| Example 15 | 15 | 17.0 | 10.0 | | | 10.0 |
| Example 16 | 16 | 17.0 | 30.0 | | | 10.0 |
| Example 17 | 17 | 10.0 | 30.0 | | | 10.0 |
| Example 18 | 18 | 12.0 | 25.0 | | | 10.0 |
| Example 19 | 19 | 20.0 | 15.0 | | | 10.0 |
| Example 20 | 20 | 22.0 | 13.6 | | | 10.0 |
| Example 21 | 21 | 17.0 | 17.6 | | | 10.0 |
| Example 22 | 22 | 17.0 | 17.6 | | | 10.0 |
| Example 23 | 23 | 17.0 | 17.6 | | | 10.0 |

TABLE 1-1-continued

| | | | | |
|---|---|---|---|---|
| Example 24 | 24 | 17.0 | 17.6 | 10.0 |
| Example 25 | 25 | 17.0 | 17.6 | 10.0 |
| Example 26 | 26 | 17.0 | 17.6 | 10.0 |
| Example 27 | 27 | 17.0 | 17.6 | 10.0 |
| Example 28 | 28 | 17.0 | 17.6 | 10.0 |
| Example 29 | 29 | 17.0 | 17.6 | 10.0 |

| | First ink receiving layer | | | | |
|---|---|---|---|---|---|
| | Polyvinyl alcohol content (parts by mass) to 100 parts by mass of first inorganic pigment | Boric acid content (parts by mass) to 100 parts by mass of polyvinyl alcohol | Thickness (μm) | Ink receiving layer total thickness (μm) | Second ink receiving layer thickness/First ink receiving layer thickness |
| Example 1 | 13.0 | 5.8 | 25.0 | 35.0 | 0.40 |
| Example 2 | 30.0 | 5.8 | 25.0 | 35.0 | 0.40 |
| Example 3 | 25.0 | 5.8 | 25.0 | 35.0 | 0.40 |
| Example 4 | 18.0 | 5.8 | 25.0 | 35.0 | 0.40 |
| Example 5 | 13.0 | 5.8 | 25.0 | 35.0 | 0.40 |
| Example 6 | 13.0 | 5.8 | 25.0 | 35.0 | 0.40 |
| Example 7 | 13.0 | 5.8 | 13.0 | 18.0 | 0.38 |
| Example 8 | 13.0 | 5.8 | 14.0 | 20.0 | 0.43 |
| Example 9 | 13.0 | 5.8 | 28.0 | 40.0 | 0.43 |
| Example 10 | 13.0 | 5.8 | 30.0 | 43.0 | 0.43 |
| Example 11 | 13.0 | 5.8 | 32.5 | 35.0 | 0.08 |
| Example 12 | 13.0 | 5.8 | 30.0 | 35.0 | 0.17 |
| Example 13 | 13.0 | 5.8 | 17.5 | 35.0 | 1.00 |
| Example 14 | 13.0 | 5.8 | 15.0 | 35.0 | 1.33 |
| Example 15 | 13.0 | 5.8 | 25.0 | 35.0 | 0.40 |
| Example 16 | 13.0 | 5.8 | 25.0 | 35.0 | 0.40 |
| Example 17 | 13.0 | 5.8 | 25.0 | 35.0 | 0.40 |
| Example 18 | 13.0 | 5.8 | 25.0 | 35.0 | 0.40 |
| Example 19 | 13.0 | 5.8 | 25.0 | 35.0 | 0.40 |
| Example 20 | 13.0 | 5.8 | 25.0 | 35.0 | 0.40 |
| Example 21 | 13.0 | 2.3 | 25.0 | 35.0 | 0.40 |
| Example 22 | 13.0 | 6.9 | 25.0 | 35.0 | 0.40 |
| Example 23 | 30.0 | 2.3 | 25.0 | 35.0 | 0.40 |
| Example 24 | 30.0 | 7.0 | 25.0 | 35.0 | 0.40 |
| Example 25 | 25.0 | 2.4 | 25.0 | 35.0 | 0.40 |
| Example 26 | 25.0 | 6.8 | 25.0 | 35.0 | 0.40 |
| Example 27 | 18.0 | 2.2 | 25.0 | 35.0 | 0.40 |
| Example 28 | 18.0 | 6.7 | 25.0 | 35.0 | 0.40 |
| Example 29 | 10.0 | 5.8 | 25.0 | 35.0 | 0.40 |

TABLE 1-2

| | | Second ink receiving layer | | | | |
|---|---|---|---|---|---|---|
| | | | | Particles | | |
| | Recording medium | Polyvinyl alcohol content (parts by mass) to 100 parts by mass of second inorganic pigment | Boric acid content (parts by mass) to 100 parts by mass of polyvinyl alcohol | Type | Particle content (parts by mass) to 100 parts by mass of second inorganic pigment | Thickness (μm) |
| Example 30 | 30 | 17.0 | 17.6 | FINESIL | 2.0 | 10.0 |
| Example 31 | 31 | 17.0 | 17.6 | X-37B | | 10.0 |
| Example 32 | 32 | 17.0 | 17.6 | | | 10.0 |
| Example 33 | 33 | 17.0 | 17.6 | | | 10.0 |
| Example 34 | 34 | 17.0 | 17.6 | | | 10.0 |
| Example 35 | 35 | 17.0 | 17.6 | | | 10.0 |
| Example 36 | 36 | 17.0 | 17.6 | | | 10.0 |
| Example 37 | 37 | 17.0 | 17.6 | | | 10.0 |
| Example 38 | 38 | 17.0 | 17.6 | | | 10.0 |
| Example 39 | 39 | 17.0 | 17.6 | | | 10.0 |
| Example 40 | 40 | 17.0 | 17.6 | | | 10.0 |
| Example 41 | 41 | 17.0 | 17.6 | | | 10.0 |
| Example 42 | 42 | 17.0 | 17.6 | | | 10.0 |
| Example 43 | 43 | 17.0 | 17.6 | | | 10.0 |
| Example 44 | 44 | 17.0 | 17.6 | | | 10.0 |
| Example 45 | 45 | 17.0 | 17.6 | | | 10.0 |

TABLE 1-2-continued

| | | | | | | |
|---|---|---|---|---|---|---|
| Example 46 | 46 | 17.0 | 17.6 | | | 10.0 |
| Example 47 | 47 | 17.0 | 17.6 | | | 10.0 |
| Example 48 | 48 | 17.0 | 17.6 | FINESIL X-37B | 0.5 | 10.0 |
| Example 49 | 49 | 17.0 | 17.6 | FINESIL X-37B | 5.0 | 10.0 |
| Example 50 | 50 | 17.0 | 17.6 | MBX-8 | 5.0 | 10.0 |
| Example 51 | 51 | 17.0 | 17.6 | BY-001 | 2.0 | 10.0 |
| Example 52 | 52 | 17.0 | 17.6 | MIZUKASIL P707A | 2.0 | 10.0 |

| | First ink receiving layer | | | | |
|---|---|---|---|---|---|
| | Polyvinyl alcohol content (parts by mass) to 100 parts by mass of first inorganic pigment | Boric acid content (parts by mass) to 100 parts by mass of polyvinyl alcohol | Thickness (μm) | Ink receiving layer total thickness (μm) | Second ink receiving layer thickness/First ink receiving layer thickness |
| Example 30 | 11.0 | 5.8 | 25.0 | 35.0 | 0.40 |
| Example 31 | 40.0 | 5.8 | 25.0 | 35.0 | 0.40 |
| Example 32 | 42.0 | 5.8 | 25.0 | 35.0 | 0.40 |
| Example 33 | 10.0 | 5.8 | 25.0 | 35.0 | 0.40 |
| Example 34 | 11.0 | 5.8 | 25.0 | 35.0 | 0.40 |
| Example 35 | 40.0 | 5.8 | 25.0 | 35.0 | 0.40 |
| Example 36 | 42.0 | 5.8 | 25.0 | 35.0 | 0.40 |
| Example 37 | 10.0 | 5.8 | 25.0 | 35.0 | 0.40 |
| Example 38 | 11.0 | 5.8 | 25.0 | 35.0 | 0.40 |
| Example 39 | 40.0 | 5.8 | 25.0 | 35.0 | 0.40 |
| Example 40 | 42.0 | 5.8 | 25.0 | 35.0 | 0.40 |
| Example 41 | 10.0 | 5.8 | 25.0 | 35.0 | 0.40 |
| Example 42 | 11.0 | 5.8 | 25.0 | 35.0 | 0.40 |
| Example 43 | 40.0 | 5.8 | 25.0 | 35.0 | 0.40 |
| Example 44 | 42.0 | 5.8 | 25.0 | 35.0 | 0.40 |
| Example 45 | 13.0 | 5.8 | 25.0 | 35.0 | 0.40 |
| Example 46 | 13.0 | 5.8 | 25.0 | 35.0 | 0.40 |
| Example 47 | 13.0 | 5.8 | 25.0 | 35.0 | 0.40 |
| Example 48 | 13.0 | 5.8 | 25.0 | 35.0 | 0.40 |
| Example 49 | 13.0 | 5.8 | 25.0 | 35.0 | 0.40 |
| Example 50 | 13.0 | 5.8 | 25.0 | 35.0 | 0.40 |
| Example 51 | 13.0 | 5.8 | 25.0 | 35.0 | 0.40 |
| Example 52 | 13.0 | 5.8 | 25.0 | 35.0 | 0.40 |

TABLE 2

| | | Second ink receiving layer | | | | |
|---|---|---|---|---|---|---|
| | | | | Particles | | |
| | Recording medium | Polyvinyl alcohol content (parts by mass) to 100 parts by mass of second inorganic pigment | Boric acid content (parts by mass) to 100 parts by mass of polyvinyl alcohol | Type | Particle content (parts by mass) to 100 parts by mass of second inorganic pigment | Thickness (μm) |
| Comparative Example 1 | 53 | 17.0 | 17.6 | FINESIL X-37B | 2.0 | 35.0 |
| Comparative Example 2 | 54 | — | — | — | — | — |
| Comparative Example 3 | 55 | — | — | — | — | — |
| Comparative Example 4 | 56 | — | — | — | — | — |
| Comparative Example 5 | 57 | — | — | — | — | — |
| Comparative Example 6 | 58 | 13.0 | 5.8 | FINESIL X-37B | 2.0 | 10.0 |
| Comparative Example 7 | 59 | 17.0 | 0 | | | 10.0 |
| Comparative Example 8 | 60 | 17.0 | 17.6 | | | 10.0 |
| Comparative Example 9 | 61 | 17.0 | 0 | | | 10.0 |
| Comparative Example 10 | 62 | 17.0 | 32.4 | | | 10.0 |
| Comparative Example 11 | 63 | 17.0 | 9.4 | | | 10.0 |
| Comparative Example 12 | 64 | 17.0 | 17.6 | | | 10.0 |

TABLE 2-continued

| | | | | | | |
|---|---|---|---|---|---|---|
| Comparative Example 13 | 65 | 17.0 | 17.6 | | | 10.0 |
| Comparative Example 14 | 66 | 17.0 | 17.6 | | | 10.0 |
| Comparative Example 15 | 67 | 17.0 | 17.6 | | | 10.0 |
| Comparative Example 16 | 68 | 17.0 | 17.6 | | | 10.0 |
| Comparative Example 17 | 69 | 17.0 | 17.6 | | | 10.0 |
| Comparative Example 18 | 70 | 17.0 | 17.6 | | | 10.0 |
| Comparative Example 19 | 71 | 17.0 | 17.6 | | | 10.0 |
| Comparative Example 20 | 72 | 17.0 | 17.6 | FINESIL X-37B | 0.3 | 10.0 |
| Comparative Example 21 | 73 | 17.0 | 17.6 | FINESIL X-37B | 7.0 | 10.0 |
| Comparative Example 22 | 74 | 17.0 | 17.6 | MIZUKASIL P707M | 2.0 | 10.0 |

| | First ink receiving layer | | | | |
|---|---|---|---|---|---|
| | Polyvinyl alcohol content (parts by mass) to 100 parts by mass of first inorganic pigment | Boric acid content (parts by mass) to 100 parts by mass of polyvinyl alcohol | Thickness (μm) | Ink receiving layer total thickness (μm) | Second ink receiving layer thickness/First ink receiving layer thickness |
| Comparative Example 1 | — | — | — | 35.0 | — |
| Comparative Example 2 | 13.0 | 5.8 | 35.0 | 35.0 | — |
| Comparative Example 3 | 30.0 | 5.8 | 35.0 | 35.0 | — |
| Comparative Example 4 | 25.0 | 5.8 | 35.0 | 35.0 | — |
| Comparative Example 5 | 18.0 | 5.8 | 35.0 | 35.0 | — |
| Comparative Example 6 | 17.0 | 17.6 | 25.0 | 35.0 | 0.40 |
| Comparative Example 7 | 13.0 | 0 | 25.0 | 35.0 | 0.40 |
| Comparative Example 8 | 13.0 | 0 | 25.0 | 35.0 | 0.40 |
| Comparative Example 9 | 13.0 | 5.8 | 25.0 | 35.0 | 0.40 |
| Comparative Example 10 | 13.0 | 5.8 | 25.0 | 35.0 | 0.40 |
| Comparative Example 11 | 13.0 | 5.8 | 25.0 | 35.0 | 0.40 |
| Comparative Example 12 | 13.0 | 1.5 | 25.0 | 35.0 | 0.40 |
| Comparative Example 13 | 13.0 | 7.7 | 25.0 | 35.0 | 0.40 |
| Comparative Example 14 | 30.0 | 1.7 | 25.0 | 35.0 | 0.40 |
| Comparative Example 15 | 30.0 | 7.7 | 25.0 | 35.0 | 0.40 |
| Comparative Example 16 | 25.0 | 1.6 | 25.0 | 35.0 | 0.40 |
| Comparative Example 17 | 25.0 | 7.6 | 25.0 | 35.0 | 0.40 |
| Comparative Example 18 | 18.0 | 1.7 | 25.0 | 35.0 | 0.40 |
| Comparative Example 19 | 18.0 | 7.8 | 25.0 | 35.0 | 0.40 |
| Comparative Example 20 | 13.0 | 5.8 | 25.0 | 35.0 | 0.40 |
| Comparative Example 21 | 13.0 | 5.8 | 25.0 | 35.0 | 0.40 |
| Comparative Example 22 | 13.0 | 5.8 | 25.0 | 35.0 | 0.40 |

TABLE 3

| | | Third ink receiving layer (Outermost layer) | | | | | Second ink receiving layer | |
|---|---|---|---|---|---|---|---|---|
| | | Polyvinyl | | Particles (coarsening agent) | | | | |
| | Recording medium | alcohol content (parts by mass) to 100 parts by mass of third inorganic pigment | Boric acid content (parts by mass) to 100 parts by mass of polyvinyl alcohol | Type | Particle content (parts by mass) to 100 parts by mass of third inorganic pigment | Thickness (μm) | Particle content (parts by mass) to 100 parts by mass of second inorganic pigment | Boric acid content (parts by mass) to 100 parts by mass of polyvinyl alcohol |
| Example 53 | 81 | 17.0 | 17.6 | FINESIL X-37B | 2.0 | 0.1 | 17.0 | 17.6 |
| Example 54 | 82 | 17.0 | 17.6 | | | 0.2 | 17.0 | 17.6 |
| Example 55 | 83 | 17.0 | 17.6 | | | 1.5 | 17.0 | 17.6 |
| Example 56 | 84 | 17.0 | 17.6 | | | 2.0 | 17.0 | 17.6 |
| Example 57 | 85 | 17.0 | 17.6 | | | 5.0 | 17.0 | 17.6 |

TABLE 3-continued

| | Second ink receiving layer | | First ink receiving layer | | | Ink receiving layer total | Second ink receiving layer thickness/first |
|---|---|---|---|---|---|---|---|
| | Particles | Thickness (μm) | Polyvinyl alcohol content (parts by mass to) 100 parts by mass of first inorganic pigment | Boric acid content (parts by mass) to 100 parts by mass of polyvinyl alcohol | Thickness (μm) | thickness (μm) | ink receiving layer thickness |
| Example 53 | — | 10.0 | 13.0 | 5.8 | 25.0 | 35.1 | 0.40 |
| Example 54 | — | 10.0 | 13.0 | 5.8 | 25.0 | 35.2 | 0.40 |
| Example 55 | — | 10.0 | 13.0 | 5.8 | 25.0 | 36.5 | 0.40 |
| Example 56 | — | 10.0 | 13.0 | 5.8 | 25.0 | 37.0 | 0.40 |
| Example 57 | — | 10.0 | 13.0 | 5.8 | 25.0 | 40.0 | 0.40 |

Evaluation

Cracking Resistance

The surface of the ink receiving layer of each recording medium was visually observed, and the cracking resistance of the sample was rated according to the following criteria. The results are shown in Tables 4-1 and 4-2 and Tables 5 and 6.

5: No crack was observed.

4: Cracks observed were so small as to be nearly invisible to the naked eye.

3: Some of the cracks observed were visible to the naked eye.

2: Many cracks visible to the naked eye were observed over the surface.

1: Innumerable large cracks were observed, and the ink receiving layer was partially separate from the substrate.

Fold Crack Resistance

The recording medium was cut into A4 size, and a solid pattern was formed over the entire surface of the recording medium with an ink jet printer (MP990, manufactured by Canon). Then the recording medium was folded into two with the solid pattern inside, and pressed to make a fold line at a load of 500 kg for 5 minutes with a press machine. The recording medium with the fold line was subjected to open-close operation 20 times, and then the fold crack resistance was rated by visually observing the fold line. The results are shown in Tables 4-1 and 4-2 and Tables 5 and 6.

5: No white streak was observed.

4: A white streak was slightly observed.

3: A white streak was observed to some extent.

2: A white streak was clearly observed.

1: A wide white streak was clearly observed.

Ink Absorbency

A green solid pattern was printed on the recording surface of each of the recording media with an ink jet printer (MP990, manufactured by Canon) in a mode for gloss photo paper gold without color correction. The ink absorbency was rated according to the following criteria by visually observing the printed portion. The results are shown in Tables 4-1 and 4-2 and Tables 5 and 6.

5: Nonuniformity was hardly observed in the solid pattern.

4: Slight nonuniformity was observed.

3: Nonuniformity observed to some extent.

2: Nonuniformity was considerably observed.

1: Overflowed ink was observed in the solid pattern.

Color Developability

A black solid pattern was printed on the recording surface of each of the recording media with an ink jet printer (MP990, manufactured by Canon) in a mode for gloss photo paper gold without color correction. The optical density of the solid pattern was measured with an optical reflection densitometer (530 spectro-densitometer, manufactured by X-Rite), and the color developability was rated according to the following criteria. The results are shown in Tables 4-1 and 4-2 and Tables 5 and 6.

5: 2.20 or more

4: 2.15 or more and less than 2.20

3: 2.10 or more and less than 2.15

2: 2.00 or more and less than 2.10

1: Less than 2.00

Ease of Page Turning

Each recording medium was cut into 20 pieces measuring 10 cm×10 cm, and the 20 pieces were stacked and bound at one side with a binder. Then, the pieces at the free side not bound with the binder were turned over one by one. The ease of page turning was thus rated according to the following criteria. The results are shown in Tables 4-1 and 4-2 and Tables 5 and 6.

5: The pieces had very smooth surfaces and were very easy to turn over.

4: The pieces had smooth surfaces and were easy to turn over considerably.

3: The pieces were easy to turn over.

2: The pieces had unsmooth surfaces with a texture of sticking to each other and were not easy to turn over.

1: The pieces had considerably unsmooth surfaces with a texture of sticking tightly to each other and were difficult to turn over.

Glossiness

The glossiness of each recording medium was measured at 20° with a gloss meter VG2000 (manufactured by Nippon Denshoku Industries). The glossiness was rated according to the following criteria. The results are shown in Tables 4-1 and 4-2 and Tables 5 and 6.

5: 20° glossiness was 30 or more.

4: 20° glossiness was 25 or more and less than 30.

3: 20° glossiness was 20 or more and less than 25.

2: 20° glossiness was 15 or more and less than 20.

1: 20° glossiness was less than 15.

TABLE 4-1

| | Recording medium | Evaluation results | | | | | |
|---|---|---|---|---|---|---|---|
| | | Cracking resistance | Fold crack resistance | Ink absorbency | Color developability | Ease of page turning | Glossiness |
| Example 1 | 1 | 5 | 5 | 5 | 5 | 4 | 3 |
| Example 2 | 2 | 5 | 4 | 5 | 4 | 4 | 3 |
| Example 3 | 3 | 5 | 4 | 5 | 4 | 4 | 3 |
| Example 4 | 4 | 5 | 4 | 5 | 4 | 4 | 3 |
| Example 5 | 5 | 5 | 4 | 5 | 4 | 4 | 3 |
| Example 6 | 6 | 5 | 4 | 5 | 4 | 4 | 3 |
| Example 7 | 7 | 5 | 5 | 3 | 3 | 3 | 4 |
| Example 8 | 8 | 5 | 5 | 4 | 4 | 3 | 4 |
| Example 9 | 9 | 4 | 4 | 5 | 5 | 4 | 3 |
| Example 10 | 10 | 3 | 3 | 5 | 5 | 4 | 3 |
| Example 11 | 11 | 5 | 5 | 3 | 4 | 3 | 4 |
| Example 12 | 12 | 5 | 5 | 4 | 4 | 3 | 4 |
| Example 13 | 13 | 5 | 4 | 5 | 5 | 5 | 3 |
| Example 14 | 14 | 4 | 3 | 5 | 5 | 5 | 3 |
| Example 15 | 15 | 4 | 5 | 3 | 5 | 4 | 4 |
| Example 16 | 16 | 5 | 3 | 5 | 5 | 4 | 4 |
| Example 17 | 17 | 3 | 3 | 5 | 5 | 4 | 4 |
| Example 18 | 18 | 4 | 4 | 5 | 5 | 4 | 4 |
| Example 19 | 19 | 5 | 5 | 4 | 5 | 4 | 4 |
| Example 20 | 20 | 5 | 5 | 3 | 4 | 4 | 4 |
| Example 21 | 21 | 3 | 5 | 4 | 5 | 4 | 4 |
| Example 22 | 22 | 5 | 3 | 5 | 5 | 4 | 4 |
| Example 23 | 23 | 3 | 4 | 3 | 4 | 4 | 4 |
| Example 24 | 24 | 5 | 3 | 4 | 4 | 4 | 4 |
| Example 25 | 25 | 3 | 4 | 3 | 4 | 4 | 4 |
| Example 26 | 26 | 5 | 3 | 4 | 4 | 4 | 4 |
| Example 27 | 27 | 3 | 4 | 4 | 4 | 4 | 4 |
| Example 28 | 28 | 5 | 3 | 5 | 4 | 4 | 4 |
| Example 29 | 29 | 3 | 3 | 5 | 5 | 4 | 4 |

TABLE 4-2

| | Recording medium | Evaluation results | | | | | |
|---|---|---|---|---|---|---|---|
| | | Cracking resistance | Fold crack resistance | Ink absorbency | Color developability | Ease of page turning | Glossiness |
| Example 30 | 30 | 4 | 4 | 5 | 5 | 4 | 4 |
| Example 31 | 31 | 5 | 5 | 4 | 5 | 4 | 4 |
| Example 32 | 32 | 5 | 5 | 3 | 4 | 4 | 4 |
| Example 33 | 33 | 3 | 3 | 4 | 4 | 4 | 4 |
| Example 34 | 34 | 4 | 4 | 5 | 4 | 4 | 4 |
| Example 35 | 35 | 5 | 5 | 4 | 4 | 4 | 4 |
| Example 36 | 36 | 5 | 5 | 3 | 4 | 4 | 4 |
| Example 37 | 37 | 3 | 3 | 5 | 4 | 4 | 4 |
| Example 38 | 38 | 4 | 4 | 5 | 4 | 4 | 4 |
| Example 39 | 39 | 5 | 5 | 4 | 4 | 4 | 4 |
| Example 40 | 40 | 5 | 5 | 3 | 3 | 4 | 4 |
| Example 41 | 41 | 3 | 3 | 5 | 4 | 4 | 4 |
| Example 42 | 42 | 4 | 4 | 5 | 4 | 4 | 4 |
| Example 43 | 43 | 5 | 5 | 4 | 4 | 4 | 4 |
| Example 44 | 44 | 5 | 5 | 3 | 3 | 4 | 4 |
| Example 45 | 45 | 3 | 3 | 5 | 5 | 4 | 4 |
| Example 46 | 46 | 3 | 3 | 5 | 4 | 4 | 4 |
| Example 47 | 47 | 5 | 3 | 5 | 4 | 4 | 4 |
| Example 48 | 48 | 5 | 5 | 5 | 5 | 3 | 4 |
| Example 49 | 49 | 5 | 5 | 5 | 5 | 5 | 3 |
| Example 50 | 50 | 5 | 5 | 5 | 5 | 5 | 3 |
| Example 51 | 51 | 5 | 5 | 5 | 5 | 5 | 3 |
| Example 52 | 52 | 5 | 5 | 5 | 5 | 5 | 3 |

TABLE 5

| | Recording medium | Evaluation results | | | | | |
|---|---|---|---|---|---|---|---|
| | | Cracking resistance | Fold crack resistance | Ink absorbency | Color developability | Ease of page turning | Glossiness |
| Comparative Example 1 | 51 | 1 | 1 | 5 | 5 | 4 | 4 |
| Comparative Example 2 | 52 | 5 | 5 | 2 | 2 | 1 | 5 |
| Comparative Example 3 | 53 | 5 | 4 | 1 | 2 | 1 | 2 |
| Comparative Example 4 | 54 | 5 | 4 | 1 | 1 | 1 | 3 |
| Comparative Example 5 | 55 | 5 | 4 | 2 | 2 | 1 | 4 |
| Comparative Example 6 | 56 | 5 | 1 | 1 | 2 | 4 | 4 |
| Comparative Example 7 | 57 | 1 | 2 | 1 | 3 | 4 | 4 |
| Comparative Example 8 | 58 | 1 | 2 | 2 | 3 | 4 | 4 |
| Comparative Example 9 | 59 | 2 | 2 | 2 | 3 | 4 | 4 |
| Comparative Example 10 | 60 | 5 | 2 | 5 | 5 | 4 | 4 |
| Comparative Example 11 | 61 | 3 | 5 | 2 | 4 | 4 | 4 |
| Comparative Example 12 | 62 | 2 | 2 | 2 | 4 | 4 | 4 |
| Comparative Example 13 | 63 | 5 | 2 | 5 | 5 | 4 | 4 |
| Comparative Example 14 | 64 | 1 | 2 | 3 | 3 | 4 | 4 |
| Comparative Example 15 | 65 | 5 | 1 | 5 | 4 | 4 | 4 |
| Comparative Example 16 | 66 | 2 | 2 | 3 | 3 | 4 | 4 |
| Comparative Example 17 | 67 | 5 | 1 | 5 | 4 | 4 | 4 |
| Comparative Example 18 | 68 | 2 | 2 | 3 | 4 | 4 | 4 |
| Comparative Example 19 | 69 | 5 | 1 | 5 | 4 | 4 | 4 |
| Comparative Example 20 | 70 | 5 | 5 | 5 | 5 | 1 | 4 |
| Comparative Example 21 | 71 | 5 | 5 | 5 | 5 | 5 | 1 |
| Comparative Example 22 | 71 | 5 | 5 | 5 | 5 | 4 | 1 |

TABLE 6

| | Recording medium | Evaluation results | | | | | |
|---|---|---|---|---|---|---|---|
| | | Cracking resistance | Fold crack resistance | Ink absorbency | Color developability | Ease of page turning | Glossiness |
| Example 53 | 81 | 5 | 5 | 5 | 5 | 4 | 5 |
| Example 54 | 82 | 5 | 5 | 5 | 5 | 5 | 5 |
| Example 55 | 83 | 5 | 5 | 5 | 5 | 5 | 5 |
| Example 56 | 84 | 5 | 5 | 5 | 5 | 5 | 5 |
| Example 57 | 86 | 5 | 5 | 5 | 5 | 5 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076149, filed Apr. 2, 2014, which is hereby incorporated by reference herein in its entirety.

What is claimed is:

1. A recording medium comprising in this order:

a substrate;

a first ink receiving layer containing a first inorganic pigment, polyvinyl alcohol, and a boric acid compound, the first inorganic pigment containing at least one inorganic pigment selected from the group consisting of alumina, hydrated alumina and fumed silica; and a second ink receiving layer acting as an outermost layer containing fumed silica as a second inorganic pigment, particles having an average particle size in the range of 1.0 μm to 20.0 μm, polyvinyl alcohol, and boric acid compound;

wherein the boric acid compound content in the first ink receiving layer is in the range of 2.0 parts by mass to 7.0 parts by mass relative to 100 parts by mass of the polyvinyl alcohol in the first ink receiving layer, and the boric acid compound content in the second ink receiving layer is in the range of 10.0 parts by mass to 30.0 parts by mass relative to 100 parts by mass of the polyvinyl alcohol in the second ink receiving layer, wherein the content of the particles having an average particle size in the range of 1.0 μm to 20.0 μm in the second ink receiving layer is in the range of 0.5 part by mass to 5.0 parts by mass relative to 100 parts by mass of the second inorganic pigment, and wherein the first ink receiving layer has a thickness in the range of 10.0 μm to 40.0 μm.

2. The recording medium according to claim 1, wherein the first inorganic pigment and the second inorganic pigment each have a secondary average particle size in the range of 50 nm to 300 nm.

3. The recording medium according to claim 1, wherein the particles having an average particle size in the range of 1.0 μm to 20.0 μm are wet process silica.

4. The recording medium according to claim 1, wherein the polyvinyl alcohol content in the first ink receiving layer is in the range of 11.0 parts by mass to 40.0 parts by mass relative to 100 parts by mass of the first inorganic pigment.

5. The recording medium according to claim 4, wherein the polyvinyl alcohol content in the second ink receiving layer is in the range of 12.0 parts by mass to 20.0 parts by mass relative to 100 parts by mass of second inorganic pigment.

6. The recording medium according to claim 1, wherein the boric acid compound in the first ink receiving layer is orthoboric acid, and the boric acid compound in the second ink receiving layer is orthoboric acid.

7. A recording medium comprising in that order:

a substrate;

a first ink receiving layer containing a first inorganic pigment, polyvinyl alcohol, and a boric acid compound, the first inorganic pigment containing at least one inorganic pigment selected from the group consisting of alumina, hydrated alumina, and fumed silica;

a second ink receiving layer containing fumed silica as a second inorganic pigment, polyvinyl alcohol, and a boric acid compound; and a third ink receiving layer acting as an outermost layer containing fumed silica as a third inorganic pigment, particles having an average particle size in the range of 1.0 μm to 20.0 μm, polyvinyl alcohol, and a boric acid compound, wherein the boric acid compound content in the first ink receiving layer is in the range of 2.0 parts by mass to 7.0 parts by mass relative to 100 parts by mass of the polyvinyl alcohol in the first ink receiving layer, and the boric acid compound content in the second ink receiving layer is in the range of 10.0 parts by mass to 30.0 parts by mass relative to 100 parts by mass of the polyvinyl alcohol in the second ink receiving layer, wherein the content of the particles having an average particle size in the range of 1.0 μm to 20.0 μm in the third ink receiving layer is in the range of 0.5 part by mass to 5.0 parts by mass relative to 100 parts by mass of the third inorganic pigment, and wherein the first ink receiving layer has a thickness in the range of 10.0 μm to 40.0 μm.

8. The recording medium according to claim 7, wherein the first inorganic pigment and the second inorganic pigment each have a secondary average particle size in the range of 50 nm to 300 nm.

9. The recording medium according to claim 7, wherein the boric acid compound content in the third ink receiving layer is in the range of 10.0 parts by mass to 30.0 parts by mass relative to 100 parts by mass of the polyvinyl alcohol in the third ink receiving layer.

10. The recording medium according to claim 7, wherein the particles having an average particle size in the range of 1.0 μm to 20.0 μm are wet process silica.

11. The recording medium according to claim 7, wherein the polyvinyl alcohol content in the first ink receiving layer is in the range of 11.0 parts by mass to 40.0 parts by mass relative to 100 parts by mass of the first inorganic pigment.

12. The recording medium according to claim 11, wherein the polyvinyl alcohol content in the second ink receiving layer is in the range of 12.0 parts by mass to 20.0 parts by mass relative to 100 parts by mass of the second inorganic pigment.

13. The recording medium according to claim 7, wherein the boric acid compound in the first ink receiving layer is orthoboric acid, and the boric acid compound in the second ink receiving layer is orthoboric acid.

14. The recording medium according to claim 1, wherein the second ink receiving layer has a thickness in the range of 2.5 μm to 25.0 μm.

15. The recording medium according to claim 7, wherein the second ink receiving layer has a thickness in the range of 2.5 μm to 25.0 μm.

16. The recording medium according to claim 7, wherein the third ink receiving layer has a thickness in the range of 0.1 μm to 10.0 μm.

* * * * *